US008679709B2

(12) United States Patent
Nukada et al.

(10) Patent No.: US 8,679,709 B2
(45) Date of Patent: Mar. 25, 2014

(54) ELECTROPHOTOGRAPHIC PHOTORECEPTOR, PROCESS CARTRIDGE, IMAGE FORMING APPARATUS, AND FILM FORMING COATING SOLUTION

(75) Inventors: Katsumi Nukada, Kanagawa (JP); Wataru Yamada, Kanagawa (JP); Masahiro Iwasaki, Kanagawa (JP); Kazuhiro Koseki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 812 days.

(21) Appl. No.: 12/049,718

(22) Filed: Mar. 17, 2008

(65) Prior Publication Data

US 2009/0004583 A1 Jan. 1, 2009

(30) Foreign Application Priority Data

Jun. 28, 2007 (JP) ..... 2007-170785
Dec. 20, 2007 (JP) ..... 2007-328748

(51) Int. Cl.
*G03G 5/047* (2006.01)
*G03G 5/147* (2006.01)

(52) U.S. Cl.
USPC ..... 430/58.5; 430/58.05; 430/66

(58) Field of Classification Search
USPC ..... 430/58.05, 58.5, 66
See application file for complete search history.

(56) References Cited

U.S. PATENT DOCUMENTS 4,818,650 A 4/1989 Limburg et al.
4,956,440 A 9/1990 Limburg et al.
5,283,145 A 2/1994 Nukada et al.
5,290,928 A 3/1994 Nukada et al.
5,298,617 A 3/1994 Nukada et al.
5,302,479 A 4/1994 Daimon et al.
5,308,728 A 5/1994 Imai et al.
5,338,636 A 8/1994 Nukada et al.
5,358,813 A 10/1994 Iijima et al.
5,378,569 A 1/1995 Nukada et al.
5,393,629 A 2/1995 Nukada et al.
5,416,207 A 5/1995 Imai et al.
5,456,989 A 10/1995 Nogami et al.
5,459,004 A 10/1995 Daimon et al.
5,463,043 A 10/1995 Nukada et al.
5,639,581 A 6/1997 Iwasaki et al.
5,654,119 A 8/1997 Ishii et al.
5,734,003 A 3/1998 Iwasaki et al.

(Continued)

FOREIGN PATENT DOCUMENTS

CN 101196697 A 6/2008
EP 0 377 998 A2 7/1990

(Continued)

OTHER PUBLICATIONS

Machine Translation of JP 2006276103 A.*

(Continued)

*Primary Examiner* — Jonathan Jelsma
(74) *Attorney, Agent, or Firm* — Oliff PLC

(57) ABSTRACT

According to the invention, there is provided an electrophotographic photoreceptor comprising a conductive substrate and a photosensitive layer provided on a surface of the conductive substrate, an outermost layer of the photosensitive layer containing a crosslinked product composed of a guanamine compound and at least one charge transporting material having at least one substituent selected from the group consisting of —OH, —$OCH_3$, —$NH_2$, —SH, and —COOH.

20 Claims, 6 Drawing Sheets

(56) References Cited

U.S. PATENT DOCUMENTS

| | | | | |
|---|---|---|---|---|
| 5,932,384 | A | 8/1999 | Mitsumori et al. | |
| 6,180,303 | B1 | 1/2001 | Uematsu et al. | |
| 6,489,069 | B1 * | 12/2002 | Itami et al. | 430/58.2 |
| 6,555,279 | B2 * | 4/2003 | Nakata et al. | 430/66 |
| 6,829,454 | B2 | 12/2004 | Miyakawa et al. | |
| 7,302,210 | B2 | 11/2007 | Fukushima et al. | |
| 7,384,717 | B2 | 6/2008 | Dinh et al. | |
| 2001/0031412 | A1 | 10/2001 | Itami et al. | |
| 2002/0106570 | A1 | 8/2002 | Kami et al. | |
| 2002/0119382 | A1 | 8/2002 | Nakata et al. | |
| 2003/0129512 | A1 | 7/2003 | Sugino et al. | |
| 2003/0194625 | A1 * | 10/2003 | Tanaka et al. | 430/58.8 |
| 2004/0063014 | A1 * | 4/2004 | Yoshimura et al. | 430/59.6 |
| 2005/0026058 | A1 | 2/2005 | Kami et al. | |
| 2005/0181291 | A1 | 8/2005 | Kami et al. | |
| 2006/0093931 | A1 | 5/2006 | Itami | |
| 2006/0199092 | A1 * | 9/2006 | Sugino et al. | 430/66 |
| 2007/0065741 | A1 | 3/2007 | Iemura et al. | |
| 2007/0077506 | A1 | 4/2007 | Kihara et al. | |
| 2007/0148570 | A1 * | 6/2007 | Iwasaki et al. | 430/58.75 |
| 2008/0026308 | A1 | 1/2008 | Qi et al. | |
| 2008/0089712 | A1 * | 4/2008 | Nukada et al. | 399/159 |
| 2008/0107980 | A1 | 5/2008 | De Jong et al. | |
| 2009/0067874 | A1 | 3/2009 | Hoshio | |
| 2009/0117476 | A1 | 5/2009 | Heuft et al. | |
| 2009/0238602 | A1 | 9/2009 | Iwasaki et al. | |
| 2010/0167193 | A1 | 7/2010 | Nukada et al. | |

FOREIGN PATENT DOCUMENTS

| | | | |
|---|---|---|---|
| EP | 0 710 893 | A1 | 5/1996 |
| EP | 1 211 565 | A1 | 6/2002 |
| EP | 1 600 822 | A2 | 11/2005 |
| EP | 1 808 732 | A1 | 7/2007 |
| EP | 2 202 582 | A1 | 6/2010 |
| EP | 2 233 979 | A1 | 9/2010 |
| JP | A-56-51749 | | 5/1981 |
| JP | A-60-247647 | | 12/1985 |
| JP | A-62-251757 | | 11/1987 |
| JP | A-64-1728 | | 1/1989 |
| JP | A-02-255856 | | 10/1990 |
| JP | A-04-189873 | | 7/1992 |
| JP | A-4-281461 | | 10/1992 |
| JP | A-5-43823 | | 2/1993 |
| JP | A-05-098181 | | 4/1993 |
| JP | A-05-099737 | | 4/1993 |
| JP | A-05-140472 | | 6/1993 |
| JP | A-05-140473 | | 6/1993 |
| JP | A-05-263007 | | 10/1993 |
| JP | A-05-279591 | | 10/1993 |
| JP | A-7-146564 | | 6/1995 |
| JP | A-08-176293 | | 7/1996 |
| JP | A-08-208820 | | 8/1996 |
| JP | A-8-278645 | | 10/1996 |
| JP | A-2000-19749 | | 1/2000 |
| JP | A-2000-66424 | | 3/2000 |
| JP | A-2000-292959 | | 10/2000 |
| JP | A-2001-201876 | | 7/2001 |
| JP | A-2001-255685 | | 9/2001 |
| JP | A-2002-006524 | | 1/2002 |
| JP | A-2002-82469 | | 3/2002 |
| JP | B2-3287678 | | 3/2002 |
| JP | A-2003-084474 | | 3/2003 |
| JP | A-2003-186222 | | 7/2003 |
| JP | A-2003-186234 | | 7/2003 |
| JP | A-2004-004454 | | 1/2004 |
| JP | A-2005-062830 | | 3/2005 |
| JP | A-2005-107401 | | 4/2005 |
| JP | A-2005-195961 | | 7/2005 |
| JP | A-2005-234081 | | 9/2005 |
| JP | A-2005-234140 | | 9/2005 |
| JP | A-2005-234546 | | 9/2005 |
| JP | A-2006-84711 | | 3/2006 |
| JP | 2006276103 | A * | 10/2006 |
| JP | A-2006-267652 | | 10/2006 |
| JP | A-2007-086209 | | 4/2007 |
| JP | A-2007-155874 | | 6/2007 |
| JP | A-2007-188051 | | 7/2007 |

OTHER PUBLICATIONS

Japanese Office Action issued in Japanese Patent Application No. 2007-328748 on Apr. 13, 2010 (with translation).
Jun. 28, 2010 Office Action issued in Japanese Patent Application No. 2008-071840 (with Translation).
Apr. 24, 2012 Office Action issued in Chinese Patent Application No. 200910253353.1 (with translation).
Oct. 7, 2011 Search Report issued in European Patent Application No. 10156225.4.
Oct. 26, 2010 Search Report in European Patent Application No. 10155500.1.
Jikken Kagaku Kohza, "Experimental Chemical Lecture", 4th Edition, vol. 28, pp. 430-431 (with translation).
Jun. 7, 2012 Office Action issued in U.S. Appl. No. 12/627,723.
Jan. 9, 2012 Office Action issued in U.S. Appl. No. 12/627,723.
Mar. 9, 2012 Office Action issued in U.S. Appl. No. 12/247,794.
Aug. 30, 2011 Office Action issued in U.S. Appl. No. 12/247,794.
Mar. 29, 2011 Office Action issued in U.S. Appl. No. 12/247,794.
Dec. 3, 2012 Office Action issued in U.S. Appl. No. 12/623,916.
Jun. 21, 2012 Office Action issued in U.S. Appl. No. 12/623,916.
U.S. Appl. No. 12/623,916 in the name of Nakamura et al. filed Nov. 23, 2009.
U.S. Appl. No. 12/627,723 in the name of Haruyama et al, filed Nov. 30, 2009.
U.S. Appl. No. 12/247,794 in the name of Iwasaki et al. filed Oct. 8, 2008.
Jun. 5, 2013 Office Action issued in U.S. Appl. No. 12/623,916.

* cited by examiner

ELECTROPHOTOGRAPHIC PHOTORECEPTOR, PROCESS CARTRIDGE, IMAGE FORMING APPARATUS, AND FILM FORMING COATING SOLUTION

CROSS-REFERENCE TO RELATED APPLICATIONS

This application is based on and claims priority under 35 USC 119 from Japanese Patent Applications Nos. 2007-170785 filed on Jun. 28, 2007 and 2007-328748 filed on Dec. 20, 2007.

BACKGROUND

1. Technical Field

The present invention relates to an electrophotographic photoreceptor, a process cartridge, an image forming apparatus, and a film forming coating solution.

2. Related Art

Generally, an electrophotographic image forming apparatus has the following structure and processes. Specifically, the surface of an electrophotographic photoreceptor is uniformly charged by a charging means to desired polarity and potential, and the charged surface of the electrophotographic photoreceptor is selectively removed of charge by subjecting to image-wise exposure to form an electrostatic latent image. The latent image is then developed into a toner image by attaching a toner to the electrostatic latent image by a developing means, and the toner image is transferred to an image-receiving medium by a transfer means, then the image-receiving medium is discharged as an image formed material.

Electrophotographic photoreceptors are currently been widely used in the field of copying machines, laser beam printers and other apparatus due to advantages of high speed and high printing quality. As electrophotographic photoreceptors used in image forming apparatus, organic photoreceptors using organic photoconductive materials are mainly used which are superior in cost efficiency, manufacturability and disposability, compared to conventionally used electrophotographic photoreceptors using inorganic photoconductive materials such as selenium, selenium-tellurium alloy, selenium-arsenic alloy and cadmium sulfide.

As a charging method, a corona charging method utilizing a corona charging device has been conventionally used. However, a contact charging method having advantages such as low ozone production and low electricity consumption has recently been put into practical used and is widely used. In the contact charging method, the surface of a photoreceptor is charged by bringing a conductive member as a charging member into contact with, or in close proximity to, the surface of the photoreceptor, and applying a voltage to the charging member. There are two methods of applying a voltage to the charging member: a direct current method in which only a direct current voltage is applied, and an alternating current superimposition method in which a direct current voltage superimposed by an alternating current voltage is applied. The contact charging method has advantages of downsizing the apparatus and suppressing generation of harmful gases such as ozone.

As a transfer method, a method of transferring directly to a paper has conventionally been the mainstream. However, a method of transferring to a paper via an intermediate transfer body, in which a wider variety of paper can be used, is currently frequently used.

SUMMARY

According to an aspect of the invention, there is provided an electrophotographic photoreceptor comprising a conductive substrate and a photosensitive layer provided on a surface of the conductive substrate, an outermost layer of the photosensitive layer containing a crosslinked product composed of a guanamine compound and at least one charge transporting material having at least one substituent selected from the group consisting of —OH, —$OCH_3$, —$NH_2$, —SH, and —COOH.

BRIEF DESCRIPTION OF THE DRAWINGS

Exemplary embodiments of the present invention will be described in detail based on the following figures, wherein.

DETAILED DESCRIPTION (Electrophotographic Photoreceptor)

Figure 1:
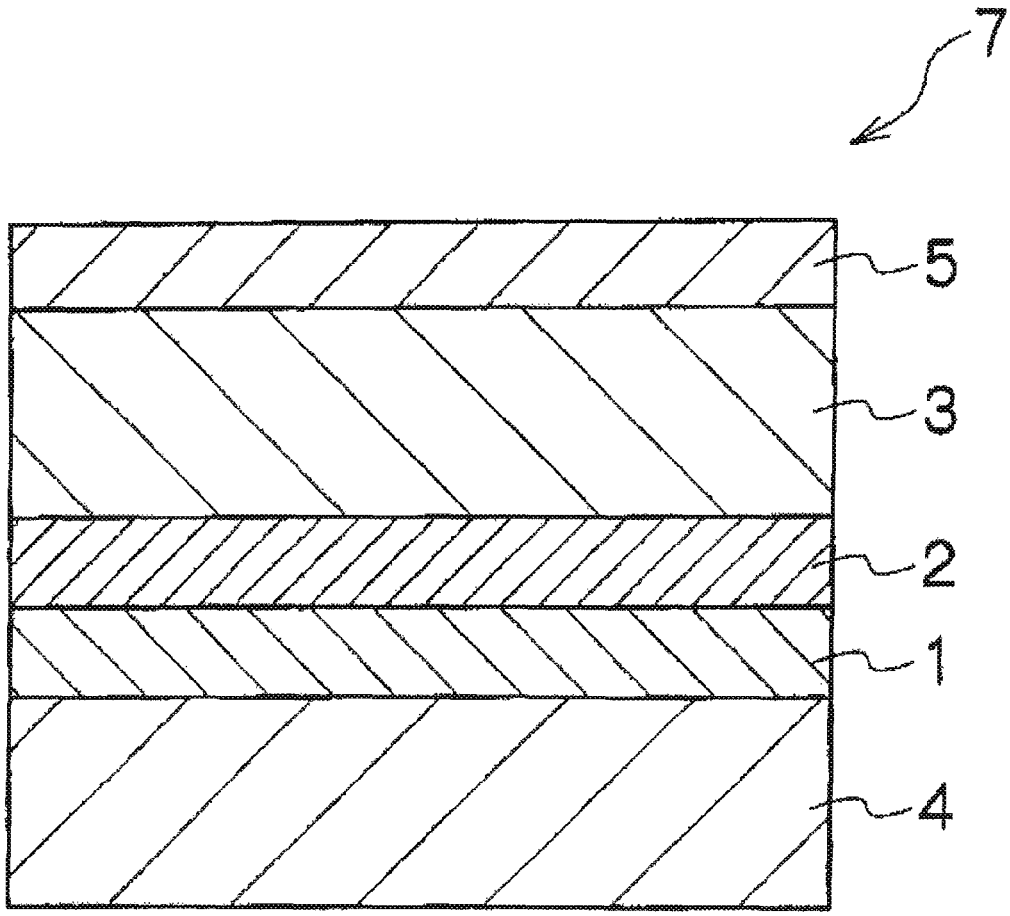
FIG. 1 is a schematic partial cross sectional view showing an electrophotographic photoreceptor according to an exemplary embodiment of the invention.

The electrophotographic photoreceptor according to an exemplary embodiment of the invention includes a conductive substrate, and a photosensitive layer provided on the surface of the conductive substrate, wherein the outermost layer of the photosensitive layer contains the below-described crosslinked product of a guanamine compound and a specific charge transporting material.

When the electrophotographic photoreceptor according to an exemplary embodiment of the invention has the above-described structure, it imparts high mechanical strength to and prevents peeling of the outermost layer of the photosensitive layer, prevents deterioration of the electrical characteristics and image quality characteristics caused by repeated use over the long term, and stably provides images with low dependence on the environment. The reason is not clear, but is presumed to be as follows.

A guanamine compound having a guanamine skeleton and a charge transporting material having a specific functional group produce a highly crosslinked product thereby forming a film whose electrical characteristics are little varied by the environment. The use of the specific compound suppresses volume shrinkage during crosslinking (curing), and improves adhesiveness of the formed film to the underlying layer.

In particular, when the compound represented by the formula (A) is used as the guanamine compound, the functional group ($R_1$ in the formula) of the compound imparts appropriate hydrophobicity thereby prevents adsorption of discharge product gas and moisture. In addition, the film is highly crosslinked due to the up to four crosslinked sites in one molecule. Furthermore, when the compound represented by the formula (I) is used as the specific charge transporting material, crosslinking occurs at a high level, and electrophotography properties and electrical resistance are improved.

In addition, the specific compound provides a film having high hardness, and decreases stabbing of the photoreceptor by conductive foreign substances come from inside and outside the image forming apparatus thereby preventing the occurrence leaks. The specific compound also suppresses wear of the film thereby preventing the occurrence leaks during repeated use over the long term.

Accordingly, the electrophotographic photoreceptor according to an exemplary embodiment of the invention achieves the above-described effects.

Preferred embodiments of the invention are illustrated in detail with reference to the figures. In the figures, same or corresponding elements are indicated by the same reference numerals, and overlapping explanation is omitted.

(Electrophotographic Photoreceptor)

The electrophotographic photoreceptor to be used in the present invention will be described below.

FIG. 1 is a schematic sectional view showing a preferred embodiment of the electrophotographic photoreceptor of the invention.

Figure 2:
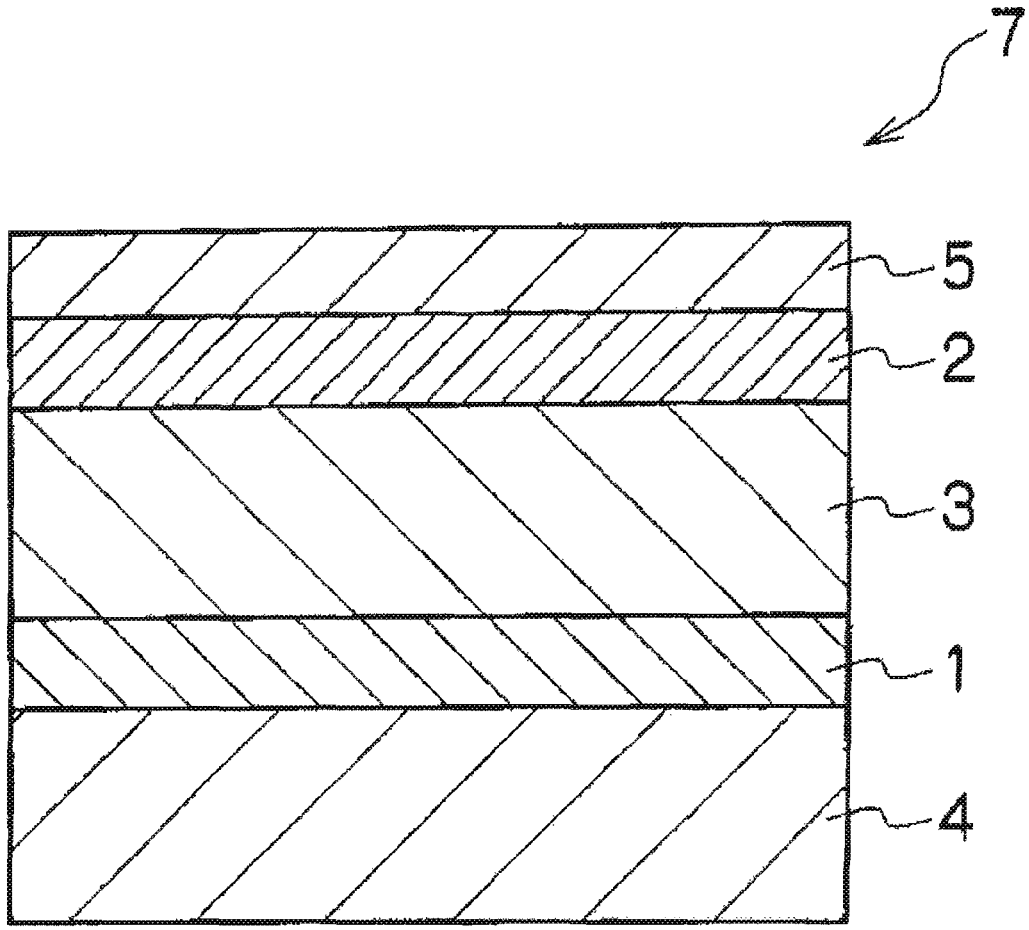
FIG. 2 is a schematic partial cross sectional view showing an electrophotographic photoreceptor according to an exemplary embodiment of the invention.
Figure 3:
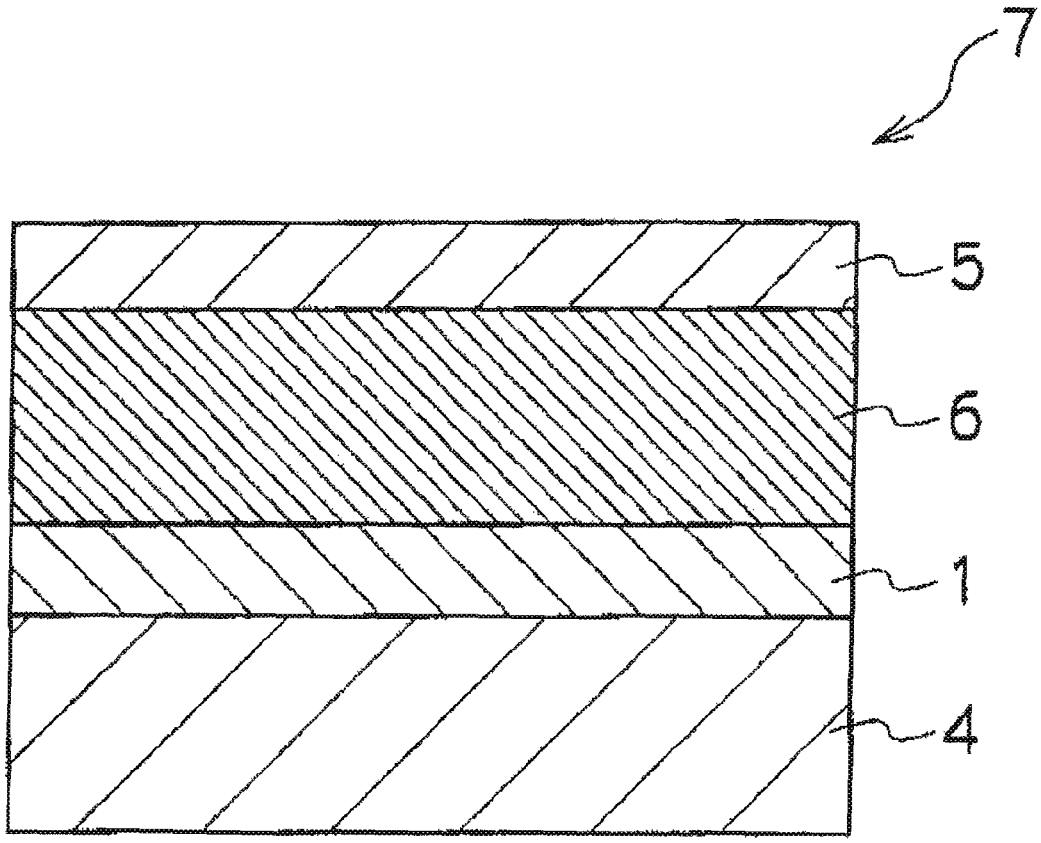
FIG. 3 is a schematic partial cross sectional view showing an electrophotographic photoreceptor according to an exemplary embodiment of the invention.

FIG. 2 and FIG. 3 are schematic sectional views showing another preferred embodiment of the electrophotographic photoreceptor of the invention.

In the electrophotographic photoreceptor 7 shown in FIG. 1, a undercoating layer 1 is provided on a conductive substrate 4, and a charge generating layer 2, a charge transporting layer 3, and a protective layer 5 are provided in this order on the undercoating layer 1 thereby forming a photosensitive layer.

The electrophotographic photoreceptor 7 shown in FIG. 2 has a photosensitive layer in which a charge generating layer 2 and a charge transporting layer 3 are separated from each other, as is the case of the electrophotographic photoreceptor 7 shown in FIG. 1. The electrophotographic photoreceptor 7 shown in FIG. 3 contains arm charge generating material and a charge transporting material in the single layer (The single-layer photosensitive layer 6 (charge generating/charge transporting layer).

In the electrophotographic photoreceptor 7 shown in FIG. 2, a undercoating layer 1 is provided on a conductive substrate 4, and a charge transporting layer 3, a charge generating layer 2, and a protective layer 5 are provided in this order on the undercoating layer 1 thereby forming a photosensitive layer. In the electrophotographic photoreceptor 7 shown in FIG. 3, a undercoating layer 1 is provided on a conductive substrate 4, and a single-layer photosensitive layer 6 and a protective layer 5 are provided in this order on the undercoating layer 1 thereby forming a photosensitive layer.

The electrophotographic photoreceptor 7 shown in FIGS. 1 through 3 corresponds to the outermost layer. In the electrophotographic photoreceptors shown in FIG. 1 through FIG. 3, the undercoating layer may be provided or not provided.

The elements constituting the electrophotographic photoreceptor 7 in FIG. 1 are further described below as examples.

<Conductive Substrate>

Examples of the conductive substrate 4 include metal plates, metal drums, and metal belts using metals such as aluminum, copper, zinc, stainless steel, chromium, nickel, molybdenum, vanadium, indium, gold, platinum or alloys thereof, and papers, plastic films and belts which are coated, deposited, or laminated with a conductive compound such as a conductive polymer and indium oxide, a metal such as aluminum, palladium and gold, or alloys thereof.

The term "conductive" means that the volume resistivity is less than $10^{13}$ Ωcm.

When the electrophotographic photoreceptor 7 is used in a laser printer, the surface of the conductive substrate 4 is preferred to be roughened so as to have a centerline average roughness (Ra) of 0.04 μm to 0.5 μm in order to prevent interference fringes which are formed when irradiated by laser light. If Ra is less than 0.04 μm, the surface is almost a mirror surface and may not exhibit satisfactory effect of interference prevention. If Ra exceeds 0.5 μm, the image quality tends to become rough even if a film is formed. When an incoherent light source is used, surface roughening for preventing interference fringes is not necessary, and occurrence of defects due to the irregular surface of the conductive substrate 4 can be prevented to achieve a longer service life.

Preferred examples of the method for surface roughening include wet honing in which an abrasive suspended in water is blown onto a support, centerless grinding in which a support is continuously ground by pressing the support onto a rotating grind stone, and anodic oxidation.

As another method of surface roughening, a method of surface roughening by forming on the substrate surface a layer of resin in which conductive or semiconductive particles are dispersed in the resin so that the surface roughening is achieved by the particles dispersed in the layer, without roughing the surface of the conductive substrate 4, is also preferably used.

In the surface-roughening treatment by anodic oxidation, an oxide film is formed on an aluminum surface by anodic oxidation in which the aluminum as anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The thickness of the anodic oxide film is preferably 0.3 to 15 μm. When the thickness of the anodic oxide film is less than 0.3 μm, the barrier property against injection may be low and fail to achieve sufficient effects. If the thickness of the anodic oxide film exceeds 15 μm, the residual potential tends to be increased due to the repeated use.

The conductive substrate 4 may be subjected to a treatment with an acidic aqueous solution or a boehmite treatment. The treatment with an acidic treatment solution comprising phosphoric acid, chromic acid and hydrofluoric acid is carried out as follows: phosphoric acid, chromic acid, and hydrofluoric acid are mixed to prepare an acidic treatment solution preferably in a mixing ratio of 10 to 11% by weight of phosphoric acid, 3 to 5% by weight of chromic acid, and 0.5 to 2% by weight of hydrofluoric acid. The concentration of the total acid components is preferably in the range of 13.5 to 18% by weight.

The treatment temperature is preferably 42 to 48° C. and by keeping the treatment temperature high, a thicker film can be obtained more speedily compared to the case of a treatment temperature that is lower than the above range. The thickness of the film is preferably 0.3 to 15 μm. If the thickness of the film is less than 0.3 μm, the barrier property against injection may be low, and sufficient effects may not be achieved. If the thickness exceeds 15 μm, the residual potential due to repeated use may be increased.

The boehmite treatment is carried out by immersing the substrate in pure water at a temperature of 90 to 100° C. for 5 to 60 nm minutes, or by bringing it into contact with heated water vapor at a temperature of 90 to 120° C. for 5 to 60 minutes. The film thickness is preferably 0.1 to 5 μm. The film may further be subjected to anodic oxidation using an electrolyte solution which sparingly dissolves the film, such as adipic acid, boric acid, borate salt, phosphate, phthalate, maleate, benzoate, tartrate, and citrate solutions.

<Undercoating Layer>

The undercoating layer 1 comprises, for example, a binding resin containing inorganic particles.

The inorganic particles preferably have powder resistance (volume resistivity) of about $10^2$ to $10^{11}$ Ω·cm so that the undercoating layer 1 can obtain adequate resistance in order to achieve leak resistance and carrier blocking properties. If the resistance value of the inorganic particles is lower than the lower limit of the range, adequate leak resistance may not be achieved, and if higher than the upper limit of the range, increase in residual potential may be caused.

Preferred examples of the inorganic particles having the above resistance value include inorganic particles of tin oxide, titanium oxide, zinc oxide, and zirconium oxide, and most preferred is zinc oxide.

The inorganic particles may be the ones which are subjected to a surface treatment. Particles which are subjected to different surface treatments, or those having different particle diameters, may be used in combination of two or more kinds.

Inorganic particles having a specific surface area (measured by a BET analysis) of 10 $m^2/g$ or more are preferably used. When the specific surface area thereof is less than 10 $m^2/g$, lowering of the electrostatic properties may easily be caused and the favorable electrophotographic characteristics may not be obtained.

By including inorganic particles and acceptive compounds, the undercoating layer which is superior in long-term stability of electrical characteristics and carrier blocking property can be achieved. Any acceptive compound by which desired characteristics can be obtained may be used, but preferred examples thereof include electron transporting substances such as quinone-based compounds such as chloranil and bromanil, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphtyl)-1,3,4-oxadiazole, and 2,5-bis(4-diethylaminophenyl)-1,3,4-oxadiazole, xanthone-based compounds, thiophene compounds and diphenoquinone compounds such as 3,3',5,5'-tetra-t-butyldiphenoquinone, and particularly preferable are compounds having an anthraquinone structure. Still more preferred examples are acceptive compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin, and purpurin.

The content of the acceptive compound may be determined as appropriate within the range where desired characteristics can be achieved, but preferably in the range of 0.01 to 20% by weight relative to inorganic particles, more preferably in the range of 0.05 to 10% by weight in terms of preventing accumulation of charge and aggregation of inorganic particles. The aggregation of the inorganic particles may cause irregular formation of conductive channels, deterioration of maintainability such as increase in residual potential, or image defects such as black points, when repeatedly used.

The acceptor compound may simply be added at the time of application of the undercoating layer, or may be previously attached to the surface of the inorganic particles. There are a dry method and a wet method as the method of attaching the acceptor compound to the surface of the inorganic particles.

When a surface treatment is conducted according to a dry method, the acceptor compound is added dropwise to the inorganic particles or sprayed thereto together with dry air or nitrogen gas, either directly or in the form of a solution in which the acceptor compound is dissolved in an organic solvent, while the inorganic particles are stirred with a mixer or the like having a high shearing force, whereby the particles are treated without causing irregular formation. The addition or spraying is preferably carried out at a temperature lower than the boiling point of the solvent. If the spraying is carried out at a temperature of not less than the boiling point of the solvent, there is a disadvantage in that the solvent may evaporate before the inorganic particles are stirred to prevent variation and the acceptor compound may coagulate locally so that the treatment without causing variation will be difficult to conduct, which is undesirable. After the addition or spraying of the acceptor compound, the inorganic particles may further be subjected to baking at a temperature of 100° C. or higher. The baking may be carried out as appropriate at a temperature and timing by which desired electrophotographic characteristics can be obtained.

When a surface treatment is conducted according to a wet method, the inorganic particles are dispersed in a solvent by means of stirring, ultrasonic wave, a sand mill, an attritor, a ball mill or the like, then the acceptor compound is added and the mixture is further stirred or dispersed, thereafter the solvent is removed, and thereby the particles are surface-treated without causing variation. The solvent is removed by filtration or distillation. After removing the solvent, the particles may be subjected to baking at a temperature of 100° C. or higher. The baking can be carried out at any temperature and timing in which desired electrophotographic characteristics can be obtained. In the wet method, the moisture contained in the inorganic particles can be removed prior to adding the surface treatment agent. The moisture can be removed by, for example, stirring and heating the particles in the solvent used for the surface treatment, or by azeotropic removal with the solvent.

The inorganic particles may be subjected to a surface treatment prior to the addition of the acceptor compound. The surface treatment agent may be any agent by which desired characteristics can be obtained, and can be selected from known materials. Examples thereof include silane coupling agents, titanate-based coupling agents, aluminum-based coupling agents and surfactants. Among these, silane coupling agents are preferably used by which favorable electrophotographic characteristics can be provided, and preferred examples are the silane coupling agents having an amino group that can impart favorable blocking properties to the undercoating layer 1.

The silane coupling agents having amino groups may be any compounds by which desired electrophotographic photoreceptor characteristics can be obtained. Specific examples thereof include γ-aminopropyltriethoxysilane, N-β-(aminoethyl)-γ-aminopropyltrimethoxysilane, N-β-(aminoethyl)-γ-aminopropylmethydilmethoxysilane, and N,N-bis(β-hydroxyethyl)-γ-aminopropyltriethoxysilane, but are not limited thereto.

The silane coupling agent may be used singly or in combination of two or more kinds thereof. Examples of the silane coupling agents which can be used in combination with the above-described silane coupling agents having an amino group include vinyltrimethoxysilane, γ-methacryloxypropyltris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but are not limited thereto.

The surface treatment method may be any known dry or wet method. Addition of an acceptor and a surface treatment using a coupling agent or the like can be carried out simultaneously.

The content of the silane coupling agent relative to the inorganic particles contained in the undercoating layer 1 can be determined as appropriate within a range in which the desired electrophotographic characteristics can be obtained, but preferably 0.5% by weight to 10% by weight from the viewpoint of improving dispersibility.

As the binding resin contained in the undercoating layer 1, any known resin that can form a favorable film and achieve desired characteristics may be used. Examples thereof include known polymer resin compounds, e.g. acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having charge transporting groups; and conductive resins such as polyaniline. Particularly preferred examples are resins which are insoluble in the coating solvent for the upper layer, specifically phenolic resins, phenol-formaldehyde resins, melamine resins, urethane resins, epoxy resins and the like. When these resins are used in combination of two or more kinds, the mixing ratio can be appropriately determined according to the circumstances.

The ratio of the metal oxide imparted with the properties as an acceptor to the binder resin, or the ratio of the inorganic particles to the binder resin, in the coating solution for forming the undercoating layer, can be appropriately determined within a range in which the desired electrophotographic photoreceptor characteristics can be obtained.

Various additives may be used for the undercoating layer 1 to improve electrical characteristics, environmental stability, or image quality. Examples of the additives include known materials such as the polycyclic condensed type or azo-based type of the electron transporting pigments, zirconium chelate compounds, titanium chelate compounds, aluminum chelate compounds, titanium alkoxide compounds, organic titanium compounds, and silane coupling agents. Silane coupling agents, which are used for surface treatment of metal oxides, may also be added to the coating solution as additives. Specific examples of the silane coupling agents include vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, isostearic acid zirconium, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminato, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These compounds may be used alone, or as a mixture or a polycondensate of two or more kinds thereof.

The solvent for preparing the coating solution for forming the undercoating layer may appropriately be selected from known organic solvents such as alcohol-based, aromatic, hydrocarbon halide-based, ketone-based, ketone alcohol-based, ether-based, and ester-based solvents. Examples thereof include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for dispersion may be used alone or as a mixture of two or more kinds thereof. When they are mixed, any mixed solvents which can solve a binder resin can be used.

To perform the dispersion, known devices such as a roll mill, a ball mill, a vibration ball mill, an attritor, a sand mill, a colloid mill, or a paint shaker can be used. For applying the undercoating layer 1, known methods such as blade coating, wire bar coating, spray coating, dip coating, bead coating, air knife coating, curtain coating or the like can be used.

The undercoating layer 1 is formed on the conductive substrate using the coating solution obtained by the above-described method.

The Vickers hardness of the undercoating layer 1 is preferably 35 or more.

The thickness of the undercoating layer 1 can be optionally determined within the range in which the desired characteristics can be obtained, but preferably 15 μm or more, more preferably 15 μm or more and 50 μm or less.

When the thickness of the undercoating layer 1 is less than 15 μm, sufficient antileak properties may not be obtained, while when the thickness of the undercoating layer 1 exceeds 50 μm, residual potential tends to remain during the long-term operation and cause the defects in image concentration.

The surface roughness of the undercoating layer 1 (ten point height of irregularities) is adjusted in the range of from ¼n to ½λ, where λ represents the wavelength of the laser for exposure and n represents a refractive index of the upper layer, in order to prevent a moire image. Particles of a resin or the like may also be added to the undercoating layer for adjusting the surface roughness thereof. Examples of the resin particles include silicone resin particles and crosslinking polymethyl methacrylate resin particles.

The undercoating layer may be subjected to grinding for adjusting the surface roughness thereof. The method such as buffing, a sandblast treatment, a wet honing, a grinding treatment and the like can be used for grinding.

The undercoating layer can be obtained by drying the applied coating, which is usually carried out by evaporating the solvent at a temperature at which a film can be formed.

<Charge Generating Layer>

The charge generating layer 2 contains a charge generating material and a binding resin. Examples of the charge generating material include azo pigments such as bisazo and trisazo pigments, condensed aromatic pigments such as dibromoantanthrone, perylene pigments, pyrrolopyrrole pigment, phthalocyanine pigment, zinc oxides, and trigonal selenium. For laser exposure in the near-infrared region, preferred examples are metal or nonmetal phthalocyanine pigments, and more preferred are hydroxy gallium phthalocyanine disclosed in Japanese Patent Application Laid-Open (JP-A) Nos. 5-263007 and 5-279591, chlorogallium phthalocyanine disclosed in JP-A No. 5-98181, dichlorotin phthalocyanine disclosed in JP-A Nos. 5-140472 and 5-140473, and titanyl phthalocyanine disclosed in JP-A Nos. 4-189873, and 5-43823. For laser exposure in the near-ultraviolet region, preferred examples are condensed aromatic pigments such as dibromoantanthrone, thioindigo-based pigments, porphyrazine compounds, zinc oxides, and trigonal selenium.

The binding resin used in the charge generating layer 2 can be selected from a wide range of insulating resins, and from organic light conductive polymers such as poly-N-vinyl carbazole, polyvinyl anthracene, polyvinyl pyrene, and polysilane. Preferable examples of the binding resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binding resins may be used alone or in combination of two or more kinds thereof. The mixing ratio between the charge generating material and the binding resin is preferably in the range of 10:1 to 1:10 by weight ratio.

The term "insulating" means that the volume resistivity is $10^{13}$ Ωcm or more.

The charge generating layer 2 may be formed using a coating solution in which the above-described charge generating materials and binding resins are dispersed in a given solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, which may be used alone or in combination of two or more kinds.

For dispersing the charge generating materials and the binding resins in a solvent, ordinary methods such as ball mill dispersion, attritor dispersion and sand mill dispersion can be used. By these dispersion methods, deformation of crystals of the charge generating material caused by dispersion can be prevented. The average particle diameter of the charge generating material to be dispersed is preferably 0.5 μm or less, more preferably 0.3 μm or less and further preferably 0.15 μm or less.

For forming the charge generating layer 2, conventional methods such as blade coating, Meyer bar coating, spray coating, dip coating, bead coating, air knife coating or curtain coating can be used.

The film thickness of the charge generating layer 2 obtained by the above-described methods is preferably 0.1 to 5.0 μm and more preferably 0.2 to 2.0 μm.

<Charge Transporting Layer>

The charge transporting layer 3 is formed by including a charge transporting material and a binding resin, or including a polymer charge transporting material.

Examples of the charge transporting material include electron transporting compounds such as quinone-based compounds such as p-benzoquinone, chloranil, bromanil, and anthraquinone, tetracyanoquinodimethane-based compounds, fluorenone compounds such as 2,4,7-trinitro fluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds. These charge transporting materials may be used alone or in combination of two or more kinds thereof, but are not limited thereto.

The charge transporting material is preferably a triaryl amine derivative represented by the following Formula (a-1) and a benzidine derivative represented by the following Formula (a-2) from the viewpoint of charge mobility.

(a-1)

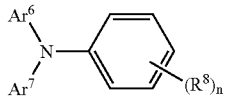

Wherein in the formula (a-1), $R^8$ represents a hydrogen atom or a methyl group. n represents 1 or 2. $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$, $R_9$ through $R_{13}$ each independently represent a hydrogen atom, a substituted or unsubstituted alkyl group, or a substituted or unsubstituted aryl group. The substituent is a halogen atom, an alkyl group having 1 to 5 carbon atoms, an alkoxy group having 1 to 5 carbon atoms, or an amino group substituted with an alkyl group having 1 to 3 carbon atoms.

(a-2)

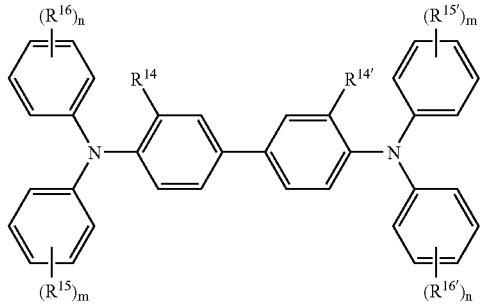

Wherein in the formula (a-2), $R^{14}$ and $R^{14'}$ may be the same or different from each other, and each independently represent a hydrogen atom, a halogen atom, an alkyl group having 1 to 5 carbon atoms, or an alkoxy group having 1 to 5 carbon atoms $R^{15}$, $R^{15'}$, $R^{16}$, and $R^{16'}$ may be the same or different from each other, and each independently represent a hydrogen atom, a halogen atom, an alkyl group having 1 to 5 carbon atoms, an alkoxy group having 1 to 5 carbon atoms, a amino group substituted with an alkyl group having 1 to 2 carbon atoms, a substituted or unsubstituted aryl group, —C($R^{17}$)=C($R^{18}$)($R^{19}$), or —CH=CH—CH=C($R^{20}$)($R^{21}$), $R^{17}$ through $R^{21}$ each independently represent a hydrogen atom, a substituted or unsubstituted alkyl group, or a substituted or unsubstituted aryl group, and m and n each independently represent an integer from 0 to 2.

Among the triarylamine derivatives represented by the formula (a-1) and the benzidine derivatives represented by the formula (a-2), triarylamine derivatives having "—$C_6H_4$—CH=CH—CH=C($R^{12}$)($R^{13}$)" and benzidine derivatives having "—CH=CH—CH=C($R^{20}$)($R^{21}$)" are particularly preferable because they are excellent in charge mobility, adhesiveness to the protective layer, and prevention of ghost development caused by the residue of the preceding image.

Examples of the binding resin used in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole and polysilane. Further, polymer charge transporting materials can also be used as the binding resin, such as the polyester-based polymer charge transporting materials disclosed in JP-A Nos. 8-176293 and 8-208820. These binding resins may be used alone or in combination of two or more kinds thereof. The mixing ratio between the charge transporting material and the binding resin is preferably 10:1 to 1:5 by weight ratio.

As the charge transporting material, polymer charge transport materials can also be used. As the polymer charge transporting material, known materials having charge transporting properties such as poly-N-vinyl carbazole and polysilane can be used. Polyester-based polymer charge transporting materials disclosed in JP-A Nos. 8-176293 and 8-208820, having high charge transporting properties, are particularly preferred. Charge transporting polymer materials can form a film independently, but may also be mixed with the above-described binding resin to form a film.

The charge transporting layer 3 can be formed using the coating solution containing the above-described constituents. Examples of the solvent used for the coating solution for forming the charge transporting layer include ordinary organic solvents such as aromatic hydrocarbons such as benzene, toluene, xylene and chlorobenzene, ketones such as acetone and 2-butanone, aliphatic hydrocarbon halides such as methylene chloride, chloroform and ethylene chloride, cyclic or straight-chained ethers such as tetrahydrofuran and ethyl ether. These solvents may be used alone or in combination of two or more kinds thereof. Known methods can be used for dispersing the above-described constituents.

For applying the coating solution for forming the charge transporting layer onto the charge generating layer 2, ordinary methods such as blade coating, Meyer bar coating, spray coating, dip coating, bead coating, air knife coating and curtain coating can be used.

The film thickness of the charge transporting layer 3 is preferably 5 to 50 μm and more preferably 10 to 30 μm.

<Protective Layer>

The protective layer 5 is the outermost layer of the electrophotographic photoreceptor 7, which is provided for the purpose of imparting surface resistance against abrasion or scratches, and enhancing the toner transferring efficiency.

The protective layer 5 contains a crosslinked product composed of a guanamine compound and at least one charge transporting material having at least one substituent selected from the group consisting of —OH, —$OCH_3$, —$NH_2$, —SH, or —COOH. The guanamine compound is further described below.

Examples of the guanamine compound include acetoguanamine, benzoguanamine, formguanamine, steroguanamine, spiroguanamine, and cyclohexylguanamine.

The guanamine compound is particularly preferably at least one of the compound represented by the formula (A) and multimers thereof. The multimers are oligomers obtained by polymerization of the compound represented by the formula (A) as the structural unit, and have a degree of polymerization of, for example, 2 or more and 200 or less, preferably 2 or more and 100 or less. The compound represented by the formula (A) may be used alone or as a mixture of two or more kinds thereof. In particular, solvent solubility of the compound represented by the formula (A) is improved when used as a mixture of two or more kinds thereof, or as a multimer (oligomer) composed the compound as the structural unit.

(A)

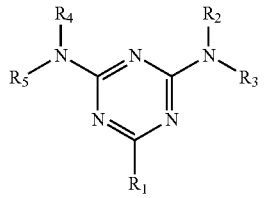

Wherein in the formula (A), $R_1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms. $R_2$ through $R_5$ each independently represent hydrogen, —$CH_2$—OH or —$CH_2$—O—$R_6$. $R_6$ represents a linear or branched alkyl group having 1 to 10 carbon atoms.

Wherein in the formula (A), the alkyl group represented by $R_1$ has 1 to 10, preferably 1 to 8, and more preferably 1 to 5 carbon atoms. The alkyl group may be linear or branched.

Wherein in the formula (A), the phenyl group represented by $R_1$ has 6 to 10, preferably 1 to 8 carbon atoms. Examples of the substituent of the phenyl group include a methyl group, an ethyl group, and a propyl group.

Wherein in the formula (A), the alicyclic hydrocarbon group represented by $R_1$ has 4 to 10, preferably 5 to 8 carbon atoms. Examples of the substituent of the alicyclic hydrocarbon group include a methyl group, an ethyl group, and a propyl group.

Wherein "—$CH_2$—O—$R_6$" represented by $R_2$ through $R_5$ in the formula (A), the alkyl group represented by $R_6$ has 1 to 10, preferably 1 to 8, and more preferably 1 to 6 carbon atoms. The alkyl group may be linear or branched. Preferable examples of the alkyl group include a methyl group, an ethyl group, and a butyl group.

The compound represented by the formula (A) is particularly preferably a compound wherein $R_1$ represents a substituted or unsubstituted phenyl group having 6 to 10 carbon atoms, and, $R_2$ through $R_5$ each independently represent —$CH_2$—O—$R_6$. $R_6$ is preferably selected from a methyl group or a n-butyl group.

The compound represented by the formula (A) is synthesized from, for example, guanamine and formaldehyde according to a known method as described in, for example, Jikken Kagaku Koza the fourth edition, vol 28, p. 430.

Specific examples of the compound represented by the formula (A) include, but not limited to, the followings. These specific examples may be monomers or compose multimers (oligomers) as the structural unit.
(A)-1
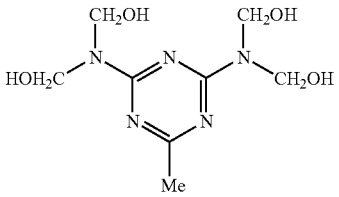
(A)-2
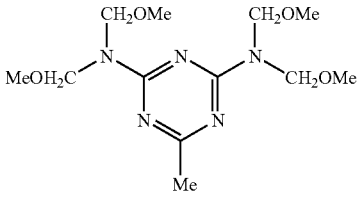
(A)-3
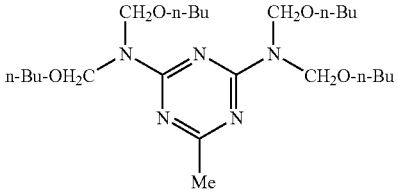
(A)-4
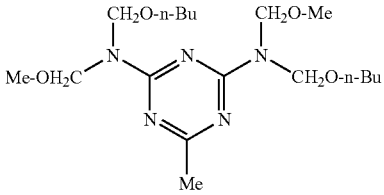
(A)-5
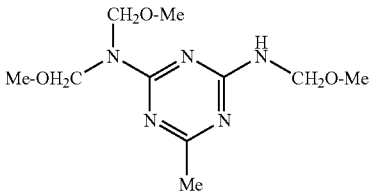
(A)-6
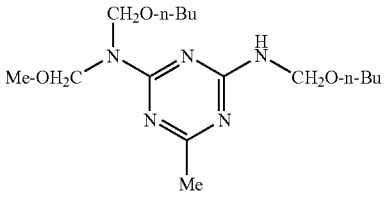
(A)-7
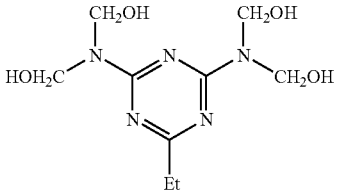
-continued
(A)-8
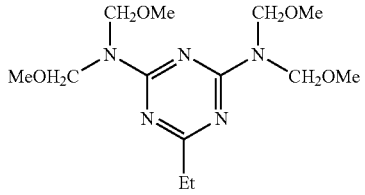
(A)-9
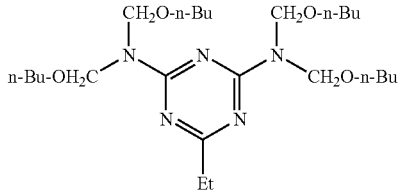
(A)-10
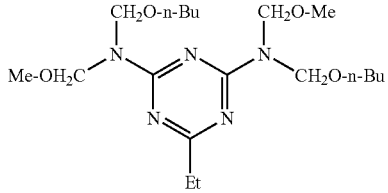
(A)-11
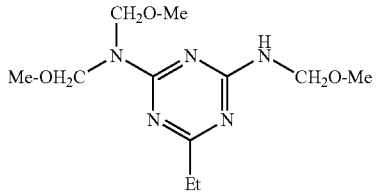
(A)-12
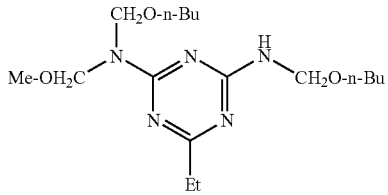
(A)-13
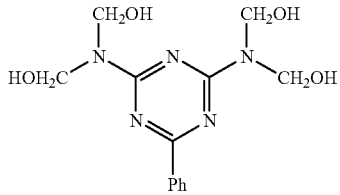
(A)-14
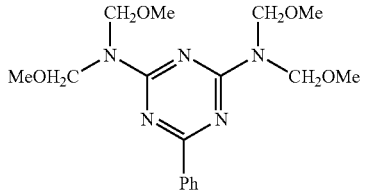
(A)-15
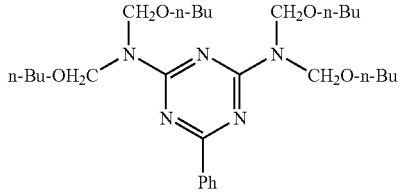

-continued
(A)-16
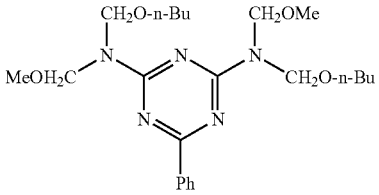
(A)-17
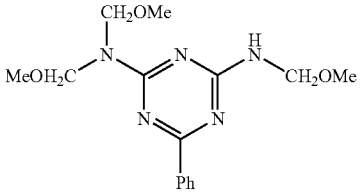
(A)-18
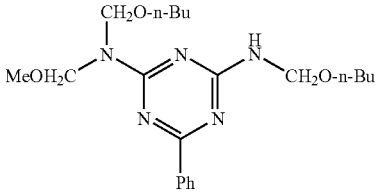
(A)-19
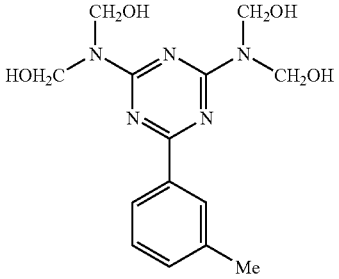
(A)-20
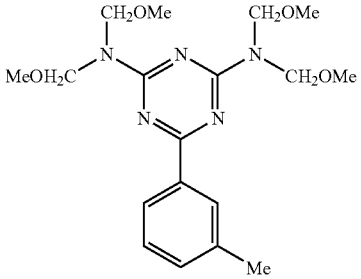
(A)-21
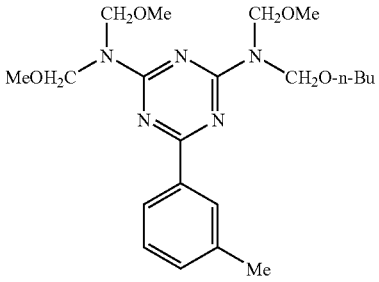
-continued
(A)-22
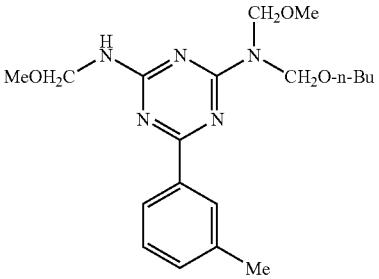
(A)-23
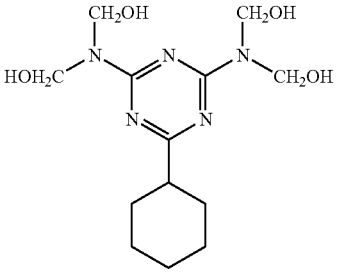
(A)-24
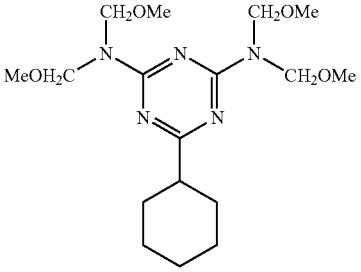
(A)-25
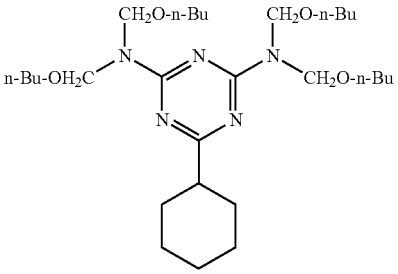
(A)-26
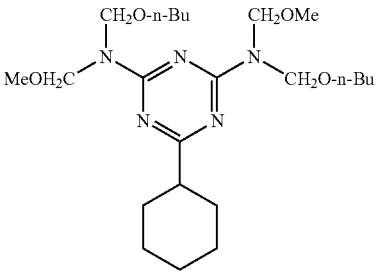

-continued
(A)-27
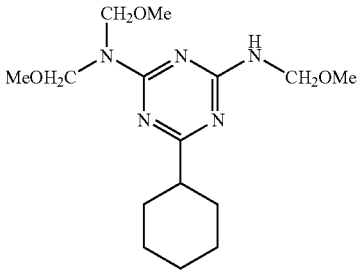
(A)-28
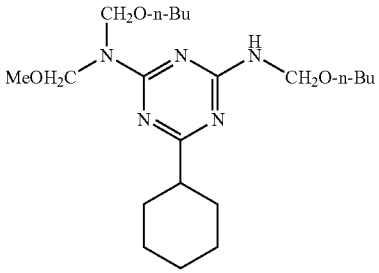
(A)-29
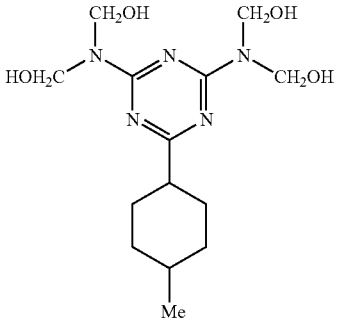
(A)-30
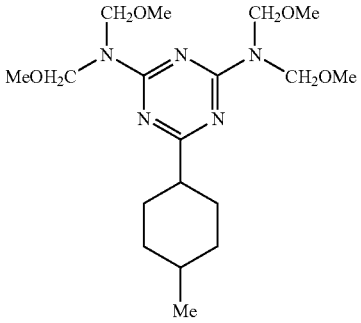
(A)-31
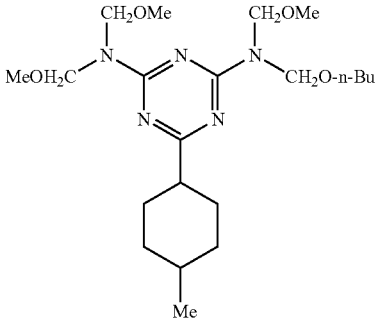
-continued
(A)-32
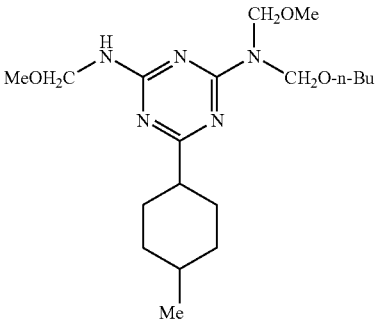
(A)-33
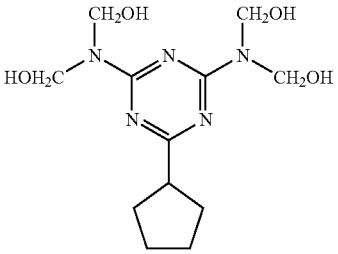
(A)-34
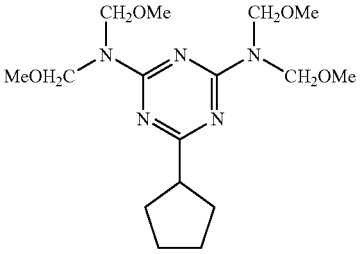
(A)-35
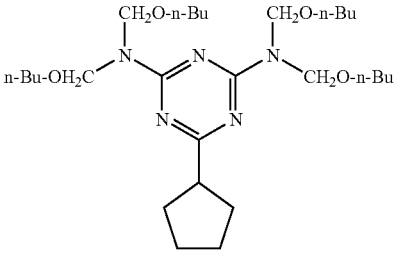
(A)-36
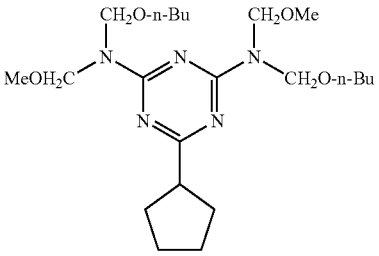
(A)-37
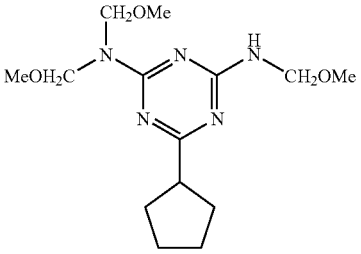

-continued (A)-38

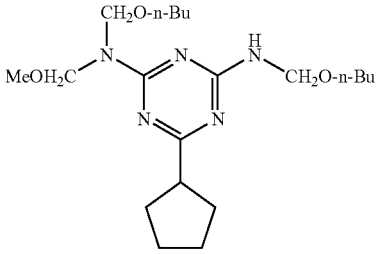

(A)-39

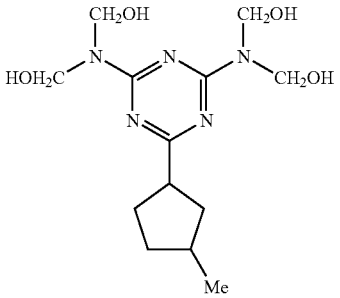

(A)-40

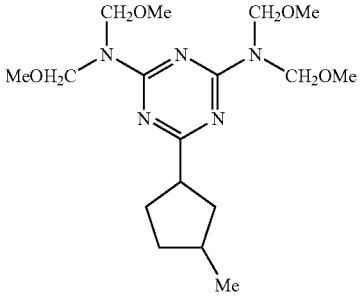

(A)-41

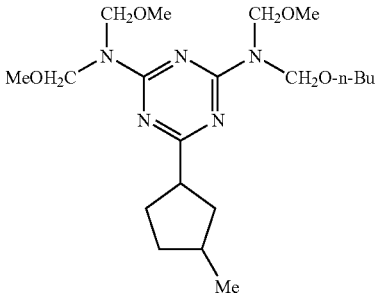

(A)-42

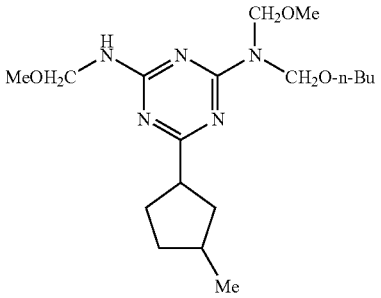

Examples of commercial products of the compound represented by the formula (A) include "SUPER BECKAMIN (R) L-148-55, SUPER BECKAMIN (R) 13-535, SUPER BECKAMIN (R) L-145-60 and SUPER BECKAMIN (R) TD-126 (manufactured by Dainippon Ink And Chemicals, Incorporated)", "NIKALACK BL-60 and NIKALACK BX-4000 (manufactured by Nippon Carbide Industries Co., Inc.)".

After the compound represented by the formula (A) is synthesized or purchased, in order to remove the influence of the residual catalyst, the compound may be dissolved in an appropriate solvent such as toluene, xylene, or ethyl acetate, followed by washing with distilled water or ion exchanged water, or treatment with an ion exchange resin.

The specific charge transporting material is further described below. The specific charge transporting material preferably has at least one substituent selected from the group consisting of —OH, —$OCH_3$, —$NH_2$, —SH, and —COOH. The specific charge transporting material particularly preferably has at least three substituents selected from the group consisting of —OH, —$OCH_3$, —$NH_2$, —SH, and —COOH. As the increase of the number of the reactive functional group (substituent) of the specific charge transporting material, the crosslinking density increases, and the strength of the crosslinked film increased. In particular, the running torque of the electrophotographic photoreceptor for a blade cleaner is reduced, which reduces damages to the blade, and wear of the electrophotographic photoreceptor. The reason of this is not known, but is probably due to that the increase of the number of the reactive functional groups increases the crosslinking density of the cured film, and the molecular motion on the outermost surface of the electrophotographic photoreceptor is suppressed and the interaction with the molecules on the surface of the blade member is weakened.

The specific charge transporting material is preferably the compound represented by the formula (I):

$$F—((—R_7—X)_{n1}R_8—Y)_{n2} \quad (I)$$

wherein in the formula (I), F represents an organic group derived from a hole transporting compound, $R_7$ and $R_8$ each independently represent a linear or branched alkylene group having 1 to 5 carbon atoms, n1 represents 0 or 1, and n2 represents an integer of 1 to 4, X represents an oxygen, NH, or sulfur atom, and Y represents —OH, —$OCH_3$, —$NH_2$, —SH, or —COOH.

Wherein in the formula (I), the organic group represented by F is preferably derived from a hole transporting compound such as an arylamine derivative. Preferable examples of the arylamine derivative include triphenylamine derivatives, and tetraphenylbenzidine derivatives.

The compound represented by the formula (I) is preferably the compound represented by the formula (II). The compound represented by the formula (II) is excellent in, in particular, stability toward charge mobility and oxidation.

(II)

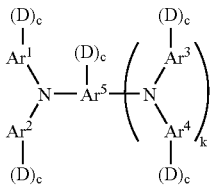

Wherein in the formula (II), $Ar^1$ through $Ar^4$ may be the same or different from each other and each independently represent a substituted or unsubstituted aryl group, $Ar^5$ represents a substituted or unsubstituted aryl group or a substituted or unsubstituted arylene group, D represents —(—$R_7$—X)$_{n1}$$R_8$—Y, c represents 0 or 1, k represents 0 or 1, the total number of D is 1 or more and 4 or less; $R_7$ and $R_8$ each independently represent a linear or branched alkylene group having 1 to 5 carbon atoms, n1 represents 0 or 1, X represents oxygen, NH, or sulfur atom, and Y represents —OH, —$OCH_3$, —$NH_2$, —SH, or —COOH.

Wherein in the formula (II), "—(—$R_7$—X)$_{n1}$$R_8$—Y" represented by D is the same as that in the formula (I), and $R_7$ and $R_8$ each independently represent a linear or branched alkylene group having 1 to 5 carbon atoms. n1 is preferably 1. X is preferably oxygen. Y is preferably a hydroxy group. The total number of D in the formula (II) corresponds to n2 in the formula (I), is preferably 2 or more and 4 or less, and more preferably 3 or more and 4 or less. In the formulae (I) and (II), when the total number of D is preferably 2 or more and 4 or less, and more preferably 3 or more and 4 or less in one molecule, the crosslinking density increases, and thus a stronger crosslinked film is formed. In particular, the running torque of the electrophotographic photoreceptor for a blade cleaner is reduced, which reduces damages to the blade, and wear of the electrophotographic photoreceptor. The reason of this is not known, but is probably due to that the increase of the number of the reactive functional groups increases the crosslinking density of the cured film, and the molecular motion on the outermost surface of the electrophotographic photoreceptor is suppressed and the interaction with the molecules on the surface of the blade member is weakened.

Wherein in the formula (II), $Ar_1$ through $Ar_4$ are preferably represented by any one from the formulae (1) through (7). The formulae (1) through (7) are shown together with "-$(D)_c$" which may be linked to $Ar_1$ through $Ar_4$.

(1)

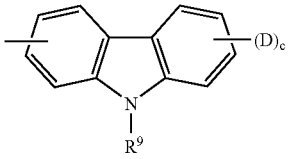

(2)

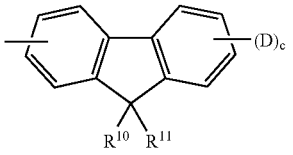

(3)

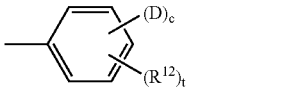

(4)

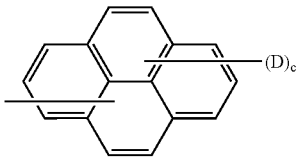

(5)

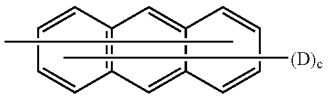

(6)

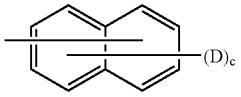

—Ar—$(Z')_s$—Ar-$(D)_c$ (7)

Wherein in the formulae (1) and (2), $R^9$ represents one selected from the group consisting of a hydrogen atom, an alkyl group having 1 to 4 carbon atoms, a phenyl group substituted with an alkyl group having 1 to 4 carbon atoms, or an alkoxy group having 1 to 4 carbon atoms, an unsubstituted phenyl group, and an aralkyl group having 7 to 10 carbon atoms, $R^{10}$ through $R^{12}$ each independently represent a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group, D and C are the same as "D" and "c" in the formula (II), s represents 0 or 1, and t represents an integer from 1 to 3.

Wherein, in the formula (7), Ar is preferably represented by the following formula (8) or (9).

(8)

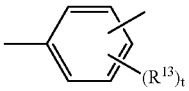

(9)

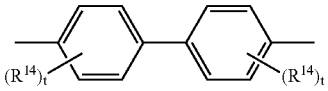

Wherein in the formulae (8) and (9), $R^{13}$ and $R^{14}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t represents an integer from 1 to 3.

Wherein in the formula (7), Z' is preferably represented by one selected from the formulae (10) through (17).

(10)

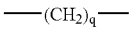

(11)

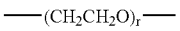

(12)

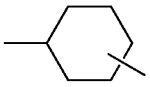

(13)

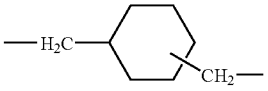

(14)

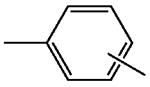

(15)

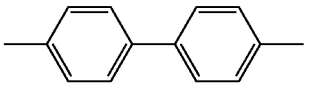

(16)

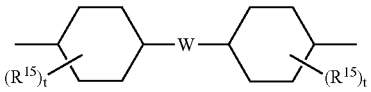

-continued (17)

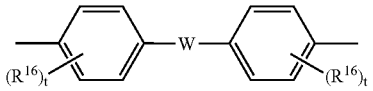

Wherein in the formulae (10) through (17), $R^{15}$ and $R^{16}$ each independently represent one selected from the group consisting of a phenyl group substituted with a hydrogen atom, an alkyl group having 1 to 4 carbon atoms, an alkoxy group having 1 to 4 carbon atoms, or an alkoxy group having 1 to 4 carbon atoms, an unsubstituted phenyl group, an aralkyl group having 7 to 10 carbon atoms, and a halogen atom, W represents a divalent group, q and r each independently represent an integer from 1 to 10, t represents an integer from 1 to 3.

Wherein in the formulae (16) and (17), W is preferably a divalent group represented by any one of the formulae (18) through (26). In the formula (25), u represents an integer from 0 to 3.

(18) $-CH_2-$

(19) $-C(CH_3)_2-$

(20) $-O-$

-continued

(21) $-S-$

(22) $-C(CF_3)_2-$

(23) $-Si(CH_3)_2-$ (24)

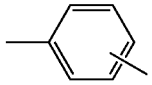

(25)

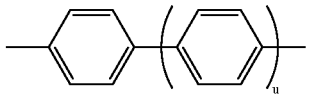

(26)

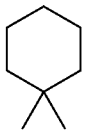

In the formula (II), when k is 0, $Ar^5$ is an aryl group as exemplified for $Ar^1$ through $Ar^4$, and when k is 1, $Ar^5$ is an arylene group obtained by removing a specific hydrogen atom from the aryl group.

Specific examples of the compound represented by the formula (I) include the following compounds (I)-1 through (I)-34. The compound represented by the formula (I) is not limited to the followings.

I-1

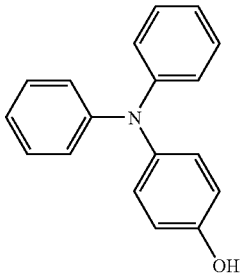

I-2

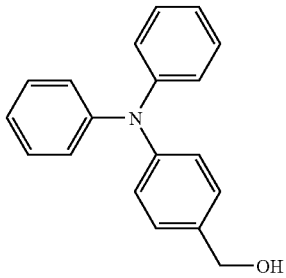

-continued
I-3
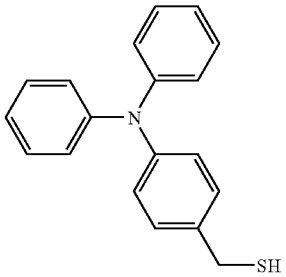
I-4
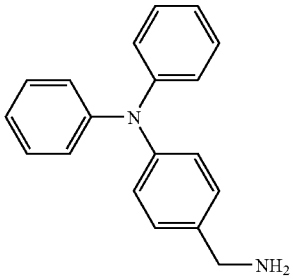
I-5
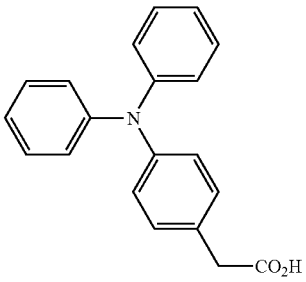
I-6
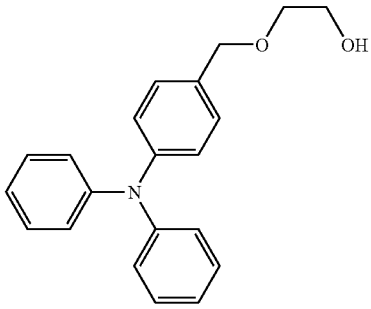
I-7
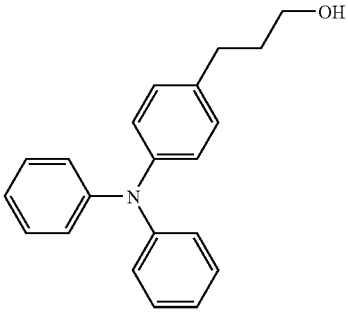

-continued
I-8
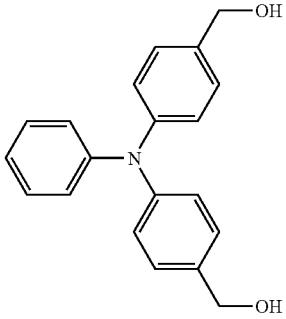
I-9
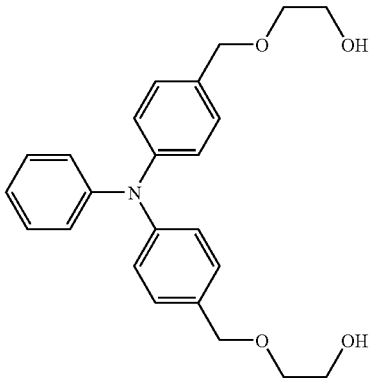
I-10
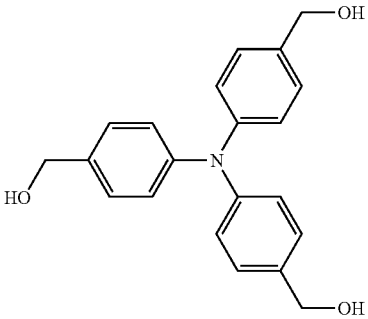
I-11
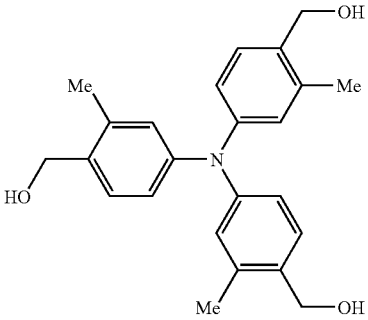

-continued
I-12
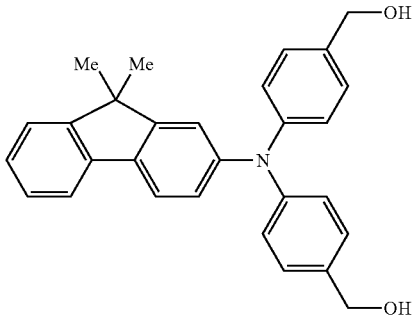
I-13
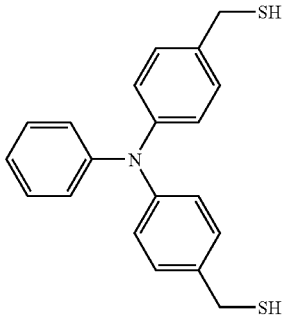
I-14
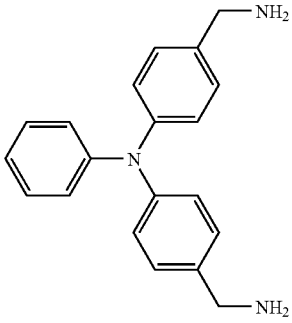
I-15
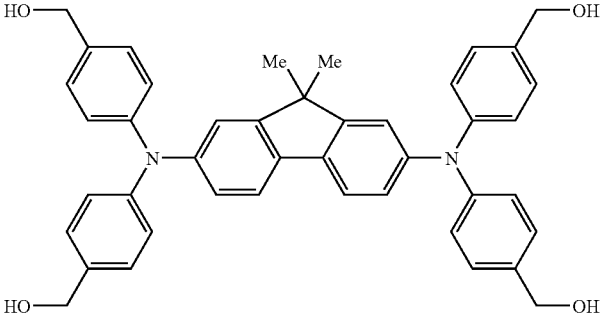

-continued
I-16
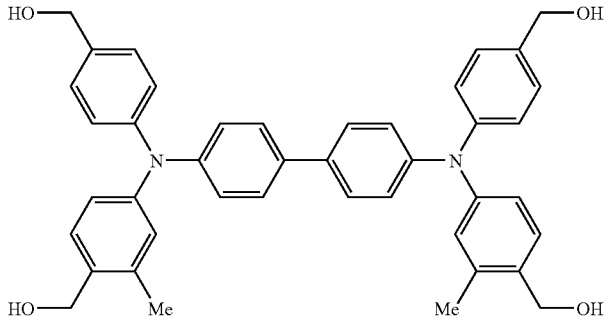
I-17
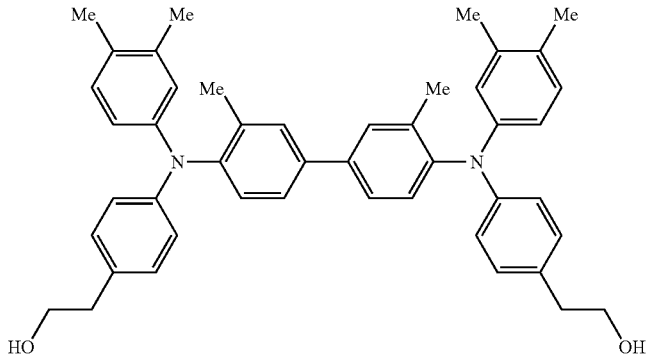
I-18
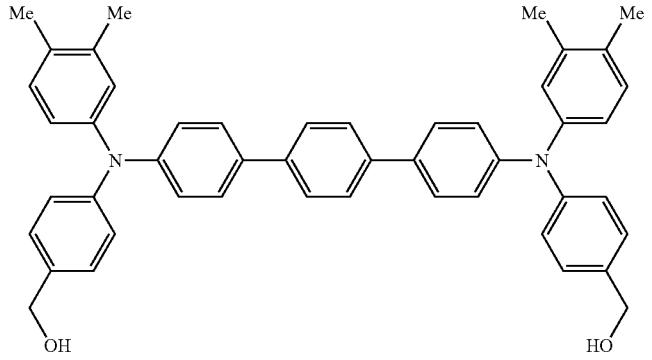
I-19
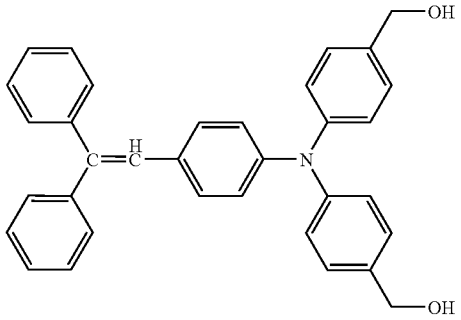

-continued
I-20
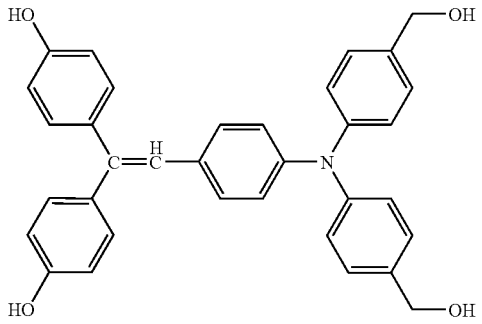
I-21
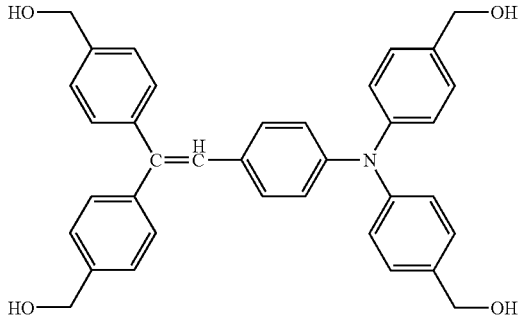
I-22
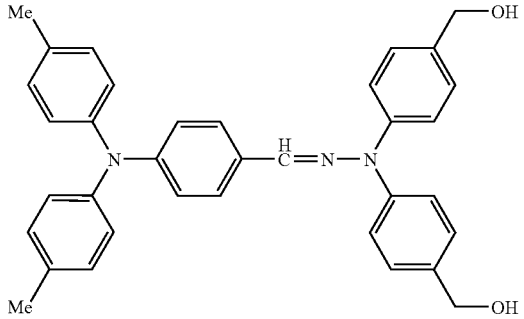
I-23
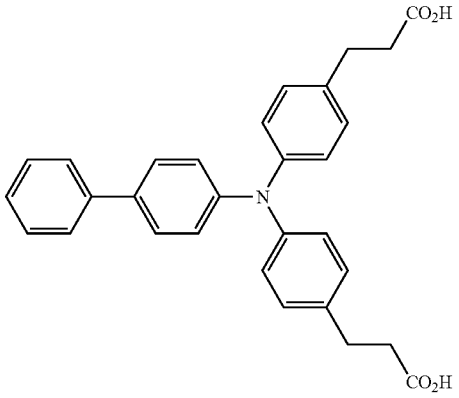

-continued
I-24
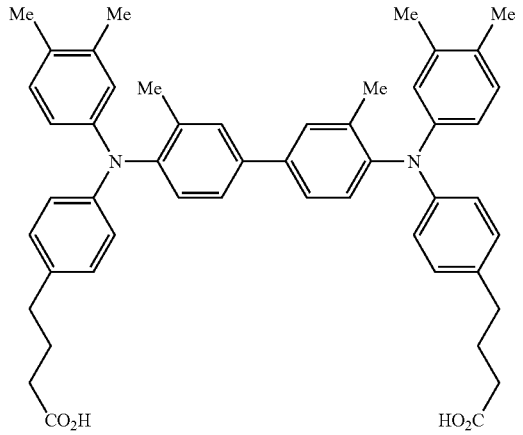
I-25
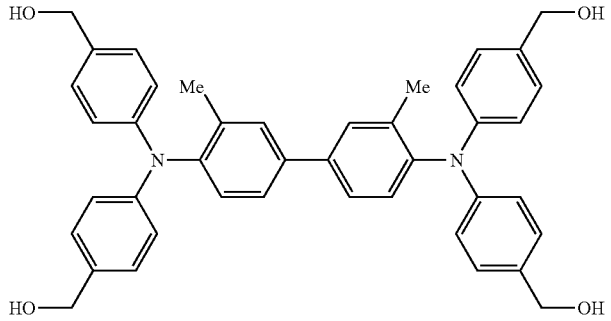
I-26
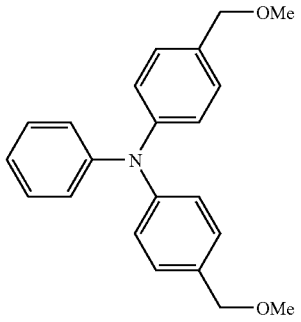
I-27
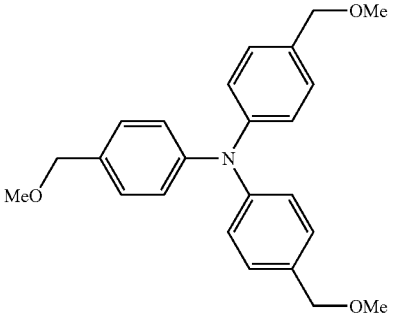

-continued
I-28
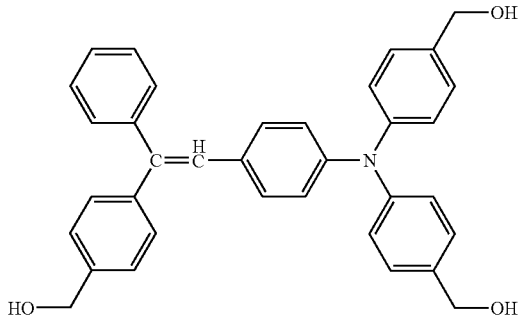
I-29
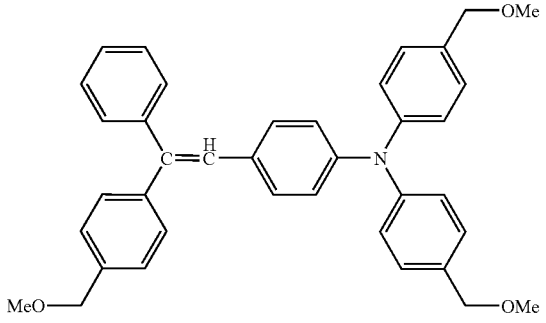
I-30
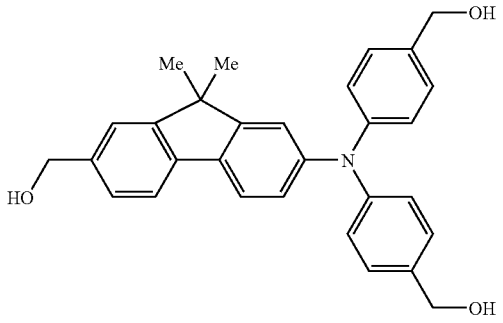
I-31
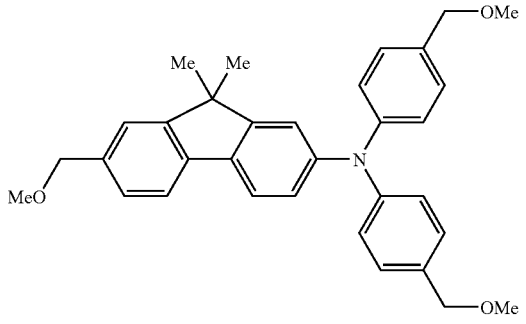

-continued

I-32

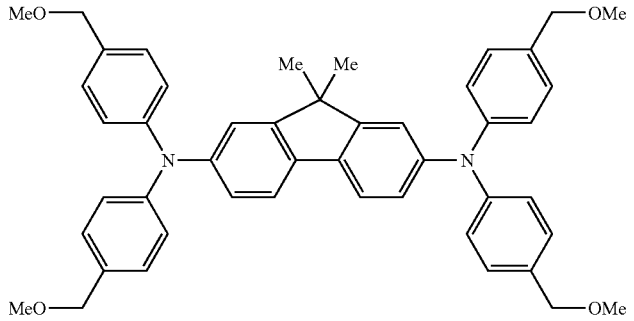

I-33

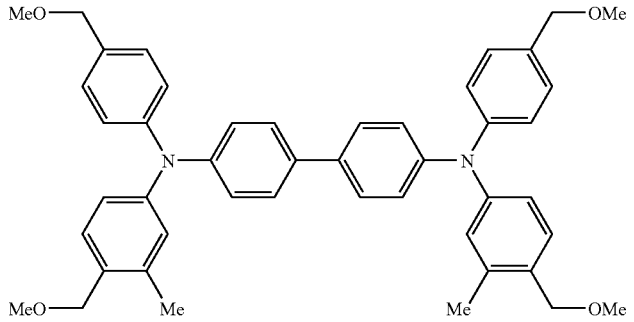

I-34

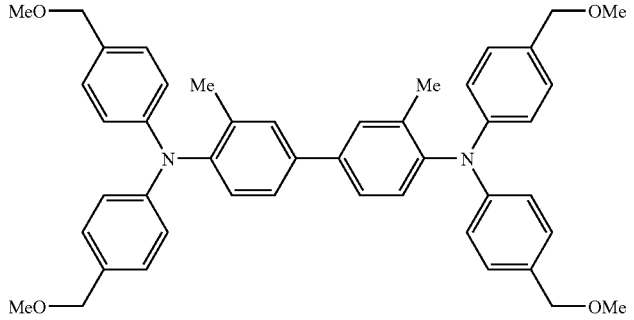

The ratio of the specific charge transporting material (the compound represented by the formula (I)) to 1 parts by weight of the guanamine compound (the compound represented by the formula (A)) is preferably from 0.2 to 4 parts by weight, more preferably from 0.3 to 3 parts by weight, and even more preferably from 0.4 to 2 parts by weight from the viewpoints of electrical characteristics and strength.

The amount of the guanamine compound (the compound represented by the formula (A)) with respect to the whole layer material is preferably 10% by weight or more and 80% by weight or less, more preferably 15% by weight or more and 70% by weight or less, and even more preferably 20% by weight or more and 65% by weight or less.

The protective layer 5 is further illustrated below. The protective layer 5 may include, in addition to the crosslinked product composed of the guanamine compound (the compound represented by the formula (A)) and the specific charge transporting material (the compound represented by the formula (I)), a phenolic resin, a melamine resin, an urea resin, an alkyd resin and the like. In order to improve the strength, it is effective to copolymerize a compound having more functional groups in one molecule, such as a spiroacetal guanamine resin (for example "CTU-GUANAMINE (manufactured by Ajinomoto-Fine-Techno Co., Inc.), with the material in the crosslinked product.

In order to prevent excess adsorption of discharge product gas, the protective layer 5 may include other heat curable resin such as a phenolic resin, a melamine resin, or a benzoguanamine resin thereby effectively prevent oxidation by discharge product gas.

The protective layer 5 of the invention may further include other coupling agents or fluorine compounds for controlling the properties such as film-forming ability, flexibility, lubricity, and adhesiveness of the film. Examples of such compounds include various silane coupling agents, and commercially available silicone-based hard coating agents.

Examples of the silane coupling agents include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane and dimethyldimethoxysilane. Examples of the commercially available hard coating agent include KP-85, X-40-9740, X-8239 (manufactured by Shin-Etsu Chemical Co., Ltd.), AY42-440, AY42-441, and AY49-208 (manufactured by Toray Dow Corning Silicone Co. Ltd.). In order to impart water repellency, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added. The amount of the silane coupling agent may be determined as appropriate. However, the amount of the fluorine-containing compound is preferably 0.25 times by weight or lower, with respect to the fluorine-free compounds. If the amount of the fluorine-containing compound exceeds the above range, the film-forming ability of the crosslinked film may be impaired.

Resins that are soluble in alcohols may also be added to the protective layer 5 for the purposes such as controlling of the discharge gas resistance, mechanical strength, scratch resistance, particle dispersibility and viscosity; reduction of the torque; controlling of the abrasive wear; extending a pot life; and others.

The alcohol-soluble resin means a resin soluble in an alcohol having 5 or less carbon atoms at a ratio of 1% by weight or more.

Examples of the resins that are soluble in an alcohol-based solvent include polyvinylbutyral resins, polyvinylformal resins, polyvinylacetal resins such as partially acetalized polyvinylacetal resins having butyral partially modified by formal or acetoacetal (for example, S-Lec B and K series, manufactured by Sekisui Chemical Co., Ltd.), polyamide resins, cellulose resins and polyvinylphenolic resins. Most preferred are polyvinyl acetal resins and polyvinyl phenolic resins from the viewpoint of electrical characteristics. The weight average molecular weight of the resin is preferably 2,000 to 100,000, more preferably 5,000 to 50,000. If the molecular weight of the resin is less than 2,000, effects achieved by adding of the resin may not be sufficient, and if exceeds 100,000, the solubility of the resin may lower to limit the content of the resin, which affect film forming ability during application. The content of the resin is preferably 1 to 40% by weight, more preferably 1 to 30% by weight, further preferably 5 to 20% by weight. If the content of the resin is less than 1% by weight, effects achieved by adding the resin may not be sufficient, and if exceeds 40% by weight, image blurring may occur at a high temperature and humidity (for example, 28° C., 85% RH).

In order to prevent the deterioration of the protective layer 5 caused by oxidizing gas such as ozone that is generated by the charging device, it is preferable to add an antioxidant to the protective layer 5. Higher resistance to oxidization than ever is required for a photoreceptor having enhanced surface mechanical strength and longer operating life, since the photoreceptor tends to be exposed to oxidizing gas for the longer period of time. Preferable examples of the antioxidants include hindered phenol-based or hindered amine-based antioxidants, and known antioxidants such as organic sulfur-based antioxidant, phosphite-based antioxidants, dithiocarbamate-based antioxidants, thiourea-based antioxidants and benzimidazole-based antioxidants also may be used. The content of the antioxidant is preferably 20% by weight or less, more preferably 10% by weight or less.

Examples of the hindered phenol-based antioxidant include 3,5-di-t-butyl-4-hydroxytoluene (BHT), 2,5-di-t-butylhydroquinone, N,N'-hexamethylene bis(3,5-di-t-butyl-4-hydroxyhydrocinnamate, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenylacrylate, and 4,4'-butylidenebis(3-methyl-6-t-butylphenol).

In order to decrease the residual potential or improve the strength, the protective layer 5 may include various particles. An example of the particles is silicon-containing particles. The silicon-containing particles include silicon as the constituent element, and specific examples thereof include colloidal silica and silicone particles. The colloidal silica used as silicon-containing particles is a dispersion of silica having an average particle diameter of 1 nm or more and 100 nm or less, preferably 10 nm or more and 30 nm or less in an acidic or alkaline aqueous dispersion, or an organic solvent such as alcohol, ketone, or ester, and may be commercially available one. The solid content of the colloidal silica in the protective layer 5 is not particularly limited, but preferably 0.1% by weight or more and 50% or less by weight, preferably 0.1% by weight or more and 30% or less by weight with respect to the total solid content of the protective layer 5 from the viewpoints of film-forming ability, electrical characteristics, and strength.

The silicone particles used as the silicon-containing particles may be selected from the common commercially available products of silicone resin particles, silicone rubber particles and silicone surface-treated silica particles. These silicone particles are spherical, and preferably have an average particle diameter of 1 to 500 nm, more preferably 10 to 100 nm. By using the silicone particles, the surface properties of an electrophotographic photoreceptor can be improved without inhibiting the crosslinking reaction, since the particles can exhibit an excellent dispersibility to resin because of being small in diameter and chemically inactive, and further, the content of the silicone particles required to achieve desirable characteristics is small. More specifically, the particles are incorporated into the strong crosslinking structure without causing variation, and thereby enhancing the lubricity and water repellency of the surface of the electrophotographic photoreceptor, and maintaining the favorable abrasion resistance and stain resistance over the long time. The content of the silicone particles in the protective layer 5 is preferably 0.1 to 30% by weight, more preferably 0.5 to 10% by weight relative to the total solid content in the protective layer 5.

Other examples of the particles include: fluorine particles such as ethylene tetrafluoride, ethylene trifluoride, propylene hexafluoride, vinyl fluoride, and vinylidene fluoride; the particles as described in the proceeding of the 8th Polymer Material Forum Lecture, p. 89, the particles composed of a resin prepared by copolymerization of a fluorocarbon resin with a hydroxy group-containing monomer; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. For the same purpose, an oil such as a silicone oil may be added. Examples of the silicone oil include: silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

The protective layer 5 may further include a metal, a metal oxide, and carbon black. Examples of the metal include aluminum, zinc, copper, chromium, nickel, silver and stainless steel, and metal-evaporated plastic particles plated with these metals. Examples of the metal oxide include zinc oxide, titanium oxide, tin oxide, antimony oxide, indium oxide, bismuth oxide, tin-doped indium oxide, antimony-doped or tantalum-doped tin oxide, and antimony-doped zirconium oxide. These metals, metal oxides and carbon black may be used alone or as a mixture of two or more kinds thereof. When two or more kinds thereof are combined, they may be simply mixed or made into a solid solution or a fusion. The average particle diameter of the conductive particles is preferably 0.3 μm or less, particularly preferably 0.1 μm or less from the viewpoint of transparency of the protective layer.

The protective layer 5 may include a curing catalyst for accelerating curing of the guanamine compound (the compound represented by the formula (A)) or the charge transporting material. The curing catalyst is preferably an acid catalyst. Examples of the acid catalyst include: aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic or aromatic sulfonic acids such as methanesulfonic acid, dodecylsulfonic acid, benzenesulfonic acid, dodecylbenzenesulfonic acid, and naphthalenesulfonic acid. Among them, sulfur-containing materials are preferable.

When a sulfur-containing material is used as the curing catalyst, the sulfur-containing material exhibits excellent functions as the curing catalyst for the guanamine compound (the compound represented by the formula (A)) or the charge transporting material, and accelerates the curing reaction, thereby improving the mechanical strength of the resultant protective layer 5. In cases where the compound represented by the formula (I) (including the formula (II)) is used as the charge transporting material, the sulfur-containing material also exhibits excellent functions as a dopant for the charge transporting material, and improves the electrical characteristics of the resultant functional layer. As a result of this, the resultant electrophotographic photoreceptor has high levels of mechanical strength, film-forming ability, and electrical characteristics.

The sulfur-containing material as the curing catalyst is preferably acidic at normal temperature (for example, 25° C.) or after heating, and is most preferably at least one of organic sulfonic acids and derivatives thereof from the viewpoints of adhesiveness, ghost resistance, and electrical characteristics. The presence of the catalyst in the protective layer 5 is readily detected by, for example, XPS.

Examples of the organic sulfonic acids and/or the derivatives thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid, and most preferred are p-toluenesulfonic acid and dodecylbenzenesulfonic acid from the viewpoint of catalytic activity and film-forming property. The salts of the organic sulfonates may also be used, as long as they call dissociate to some degree in the curable resin composition.

By using a so-called heat latent catalyst that exhibits an increased degree of catalytic activity when a temperature of a certain degree or more is applied, both of the lowering of curing temperature and the storage stability can be achieved, since the catalytic activity at a temperature at which the liquid is in storage is low, while the catalytic activity at the time of curing is high.

Examples of the heat latent catalyst include the microcapsules in which an organic sulfone compound or the like are coated with a polymer in the form of particles, porous compounds such as zeolite onto which an acid or the like is adsorbed, heat latent protonic acid catalysts in which a protonic acid and/or a derivative thereof are blocked with a base, a protonic acid and/or a derivative thereof esterified by a primary or secondary alcohol, a protonic acid and/or a derivative thereof blocked with a vinyl ether and/or a vinyl thioether, monoethyl amine complexes of boron trifluoride, and pyridine complexes of boron trifluoride.

From the viewpoint of catalytic activity, storage stability, availability and cost efficiency, the protonic acid and/or the derivative thereof that are blocked with a base are preferably used.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzene sulfonic acid, o-, m-, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of the protonic acid derivatives include neutralized alkali metal salts or alkali earth metal salts of protonic acids such as sulfonic acid and phosphoric acid, and polymer compounds in which a protonic acid skeleton is incorporated into a polymer chain (e.g., polyvinylsulfonic acid). Examples of the base to block the protonic acid include amines.

The amines are classified into primary, secondary, and tertiary amines. In the invention, any of these amines can be used without limitation.

Examples of the primary amines include methylamine, ethylamine, propyl amine, isopropylamine, n-butylamine, isobutylamine, t-butylamine, hexyl amine, 2-ethylhexylamine, secondary butylamine, allylamine and methylhexylamine.

Examples of the secondary amines include dimethylamine, diethylamine, di-n-propylamine, diisopropylamine, di-n-butylamine, diisobutylamine, di-t-butylamine, dihexylamine, di(2-ethylhexyl)amine, N-isopropyl N-isobutylamine, di(2-ethylhexyl)amine, disecondarybutylamine, diallylamine, N-methylhexylamine, 3-pipecholine, 4-pipecholine, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methyl morpholine, N,N-dimethylallylamine, N-methyl diallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole and N-methylpiperazine.

Examples of the commercially available products include NACURE 2501 (toluenesulfonic acid dissociation, methanol/isopropanol solvent, pH; 6.0 to 7.2, dissociation temperature; 80° C.), NACURE 2107 (p-toluenesulfonic acid dissociation, isopropanol solvent, pH; 8.0 to 9.0, dissociation temperature; 90° C.), NACURE 2500 (p-toluenesulfonic acid dissociation, isopropanol solvent, pH; 6.0 to 7.0, dissociation temperature, 65° C.), NACURE 2530 (p-toluenesulfonic acid dissociation, methanol/isopropanol solvent, pH; 5.7 to 6.5, dissociation temperature; 65° C.), NACURE 2547 (p-toluenesulfonic acid dissociation, aqueous solution, pH; 8.0 to 9.0, dissociation temperature; 107° C.), NACURE 2558 (p-toluene sulfonic acid dissociation, ethyleneglycol solvent, pH; 3.5 to 4.5, dissociation temperature; 80° C.), NACURE XP-357 (p-toluenesulfonic acid dissociation, methanol solvent, pH; 2.0 to 4.0, dissociation temperature; 65° C.), NACURE XP-386 (p-toluenesulfonic acid dissociation, aqueous solution, pH; 6.1 to 6.4, dissociation temperature; 80° C.), NACURE XC-2211 (p-toluenesulfonic acid dissociation, pH; 7.2 to 8.5, dissociation temperature; 80° C.), NACURE 5225 (dodecylbenzenesulfonic acid dissociation, isopropanol solvent, pH; 6.0 to 7.0, dissociation temperature; 120° C.). NACURE 5414 (dodecylbenzenesulfonic acid dissociation, xylene solvent, dissociation temperature; 120° C.), NACURE 5528 (dodecylbenzenesulfonic acid dissociation, isopropanol solvent, pH; 7.0 to 8.0, dissociation temperature; 120° C.), NACURE 5925 (dodecylbenzenesulfonic acid dissociation, pH; 7.0 to 7.5, dissociation temperature; 130° C., NACURE 1323 (dinonyl naphthalene sulfonic acid dissociation, xylene solvent, pH; 6.8 to 7.5, dissociation temperature; 150° C.), NACURE 1419 (dinonylnaphthalenesulfonic acid dissociation, xylene/methylisobutylketone solvent, dissociation temperature; 150° C.), NACURE 1557 (dinonylnaphthalenesulfonic acid dissociation, butanol/2-butoxyethanol solvent, pH; 6.5 to 7.5, dissociation temperature; 150° C.), NACURE X49-110 (dinonylnaphthalenedisulfonic acid dissociation, isobutanol/isopropanol solvent, pH; 6.5 to 7.5, dissociation temperature; 90° C.), NACURE 3525 (dinonylnaphthalenedisulfonic acid dissociation, isobutanol/isopropanol solvent, pH; 7.0 to 8.5, dissociation temperature; 120° C.), NACURE XP-383 (dinonylnaphthalenedisulfonic acid dissociation, xylene solvent, dissociation temperature; 120° C.), NACURE 3327 (dinonylnaphthalenedisulfonic acid dissociation, isobutanol/isopropanol solvent, pH; 6.5 to 7.5, dissociation temperature; 150° C.), NACURE 4167 (phosphoric acid dissociation, isopropanol/isobutanol solvent, pH; 6.8 to 7.3, dissociation temperature; 80° C.), NACURE XP-297 (phosphoric acid dissociation, water/isopropanol solvent, pH; 6.5 to 7.5, dissociation temperature; 90° C., and NACURE 4575 (phosphoric acid dissociation, pH; 7.0 to 8.0, dissociation temperature; 110° C.) (manufactured by King Industries).

These heat latent catalysts may be used alone or in combination of two or more kinds thereof.

The content of the heat latent catalyst is preferably 0.01 to 20% by weight, most preferably 0.1 to 10% by weight, with respect to the 100 parts of solid content in the resin solution. If the content exceeds 20% by weight, the catalyst may deposit as foreign matters after sintering treatment, and if less than 0.01% by weight, the catalytic activity may be lowered.

The protective layer 5 having the above-described structure is formed using a film forming coating solution containing the guanamine compound (the compound represented by the formula (A)) and at least one kind of the specific charge transporting material. The film forming coating solution contains, as necessary, the components of the protective layer 5.

The film forming coating solution may be prepared with no solvent, or as necessary a solvent. Examples of the solvent include alcohols such as methanol, ethanol, propanol, and butanol; ketones such as acetone and methyl ethyl ketone; and ethers such as tetrahydrofuran, diethyl ether, and dioxane. The solvent may be used alone or as a mixture of two or more kinds thereof, and preferably has a boiling point of 100° C. or lower. The solvent particularly preferably has at least one or more hydroxy groups (for example, an alcohol).

The amount of the solvent may be arbitrarily selected, but is usually 0.5 parts by weight or more and 30 parts by weight or less, and preferably 1 part by weight or more and 20 parts by weight or less with respect to 1 part by weight of the guanamine compound (the compound represented by the formula (A)) to prevent deposition of the guanamine compound (the compound represented by the formula (A)).

When the above-described components are reacted to make a coating solution, they are mixed and dissolved optionally under heating at a temperature from room temperature (for example, 25° C.) to 100° C., preferably from 30° C. to 80° C. for 10 minutes or more and 100 hours or less, preferably 1 hour or more and 50 hours or less. During heating, it is preferable to apply ultrasonic vibration. This probably progresses partial reaction, and facilitates formation of a film with no coating defect and little variation in the film thickness.

The film forming coating solution is applied to the charge transporting layer 3 by an ordinary method such as blade coating, Mayer bar coating, spray coating, dip coating, bead coating, air knife coating, or curtain coating. The coating is cured as necessary under heated at a temperature, for example, from 100° C. to 170° C. thereby forming the protective layer 5.

The film forming coating solution is used for photoreceptors, and, for example, fluorescence paints and anti-static films on glass or plastic surfaces. The film forming coating solution forms a film having excellent adhesiveness to the underlying layer, and prevents performance deterioration caused by repeated use over the long term.

The above-described electrophotographic photoreceptor is of function separated type.

The content of the charge generating material in the single-layer photosensitive layer 6 (charge generating/charge transporting layer) is about 10 to 85% by weight, and preferably 20 to 50% by weight. The content of the charge transporting material is preferably 5 to 50% by weight. The single-layer photosensitive layer 6 (charge generating/charge transporting layer) is formed in the same manner as the charge generating layer 2 and the charge transporting layer 3. The thickness of the single-layer photosensitive layer (charge generating/charge transporting layer) 6 is preferably about 5 to 50 μm, more preferably 10 to 40 μm.

In the above-described exemplary embodiment, a crosslinked product composed of the guanamine compound (the compound represented by the formula (A)) and the specific charge transporting material (the compound represented by the formula (I)) is included in the protective layer 5. In cases where the protective layer 5 is absent, for example, the crosslinked product may be included in the charge transporting layer placed on the outermost surface.

(Image Forming Apparatus/Process Cartridge)

Figure 4:
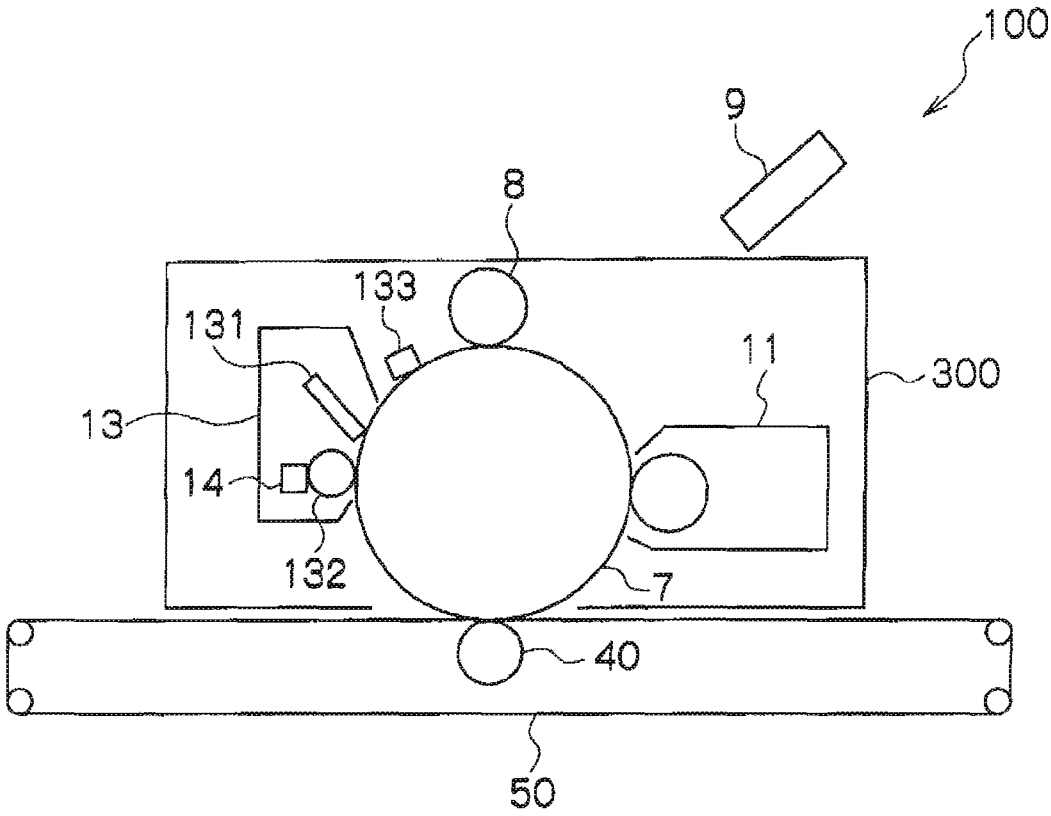
FIG. 4 is a schematic block diagram showing an image forming apparatus according to an exemplary embodiment of the invention.

FIG. 4 is a schematic block diagram showing an image forming apparatus according to an exemplary embodiment of the invention. As shown in FIG. 4, the image forming apparatus 100 includes a process cartridge 300, an exposure device 9, a transfer device 40, and an intermediate transfer medium 50, wherein the process cartridge 300 includes an electrophotographic photoreceptor 7. In the image forming apparatus 100, the exposure device 9 is arranged so as to irradiate the electrophotographic photoreceptor 7 through the opening of the process cartridge 300, the transfer device 40 is arranged so as to oppose the electrophotographic photoreceptor 7 via the intermediate transfer medium 50, and the intermediate transfer medium 50 is arranged so as to partially contact with the electrophotographic photoreceptor 7.

The process cartridge 300 integrally supports the electrophotographic photoreceptor 7, the charging device 8, a developing device 11 and a cleaning device 13, in a housing. The cleaning device 13 has a cleaning blade 131 (cleaning member). The cleaning blade 131 is disposed so as to contact the surface of the electrophotographic photoreceptor 7.

A fibrous member 132 (roll-formed) for supplying a lubricant 14 to the surface of the photoreceptor 7, and a fibrous member 133 for assisting cleaning (flat-formed) may be used if necessary.

As the charging device 8, for example, a contact type charging device using a conductive or semiconductive charging roller, a charging brush, a charging film, a charging rubber blade, a charging tube or the like can be used. Known charging devices such as a non-contact type roller charging device using a charging roller, and scorotron or corotron charging devices utilizing corona discharge can also be used.

Although not shown, in order to improve stability of the image, a photoreceptor heating member may be provided around the electrophotographic photoreceptor 7 thereby increasing the temperature of the electrophotographic photoreceptor 7 and reducing the relative temperature.

Examples of the exposure device 9 include optical instruments which can expose the surface of the photoreceptor 7 so that a desired image is formed by using light of a semiconductor laser, an LED, a liquid-crystal shutter light or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 to 450 nm can also be used. Surface-emitting type laser light sources which are capable of multi-beam output are effective to form a color image.

As the developing device 11, for example, a common developing device, in which a magnetic or non-magnetic one- or two-component developer is contacted or not contacted for forming an image, can be used. Such developing device is not particularly limited as long as it has above-described functions, and can be appropriately selected according to the preferred use. Examples thereof include known developing device in which said one- or two-component developer is applied to the photoreceptor 7 using a brush or a roller.

A toner to be used in the developing device will be described below. The toner particles used in the image forming apparatus of the present embodiment preferably have an average shape factor ($ML^2/A\times\pi/4\times100$, wherein ML represents the maximum length of a particle and A represents the projection area of the particle) of 100 to 150, more preferably 105 to 145, further preferably 110 to 140 from the viewpoint of achieving high developability; high transferring property and high quality image. Furthermore, the volume-average particle diameter of the toner particles is preferably 3 to 12 μm, more preferably 3.5 to 10 μm, further preferably 4 to 9 μm. By using such toner particles having the above-described average shape factor and volume-average particle diameter, developability and transferring property can be enhanced and a high quality image, so-called photographic image, can be obtained.

The method of producing the toner is not particularly limited as long as the obtained toner particles satisfy, the above-described average shape factor and volume-average particle diameter. Examples of the method include a kneading and grinding method in which a binding resin, a coloring agent, a releasing agent, and optionally a charge control agent or the like are mixed and kneaded, ground, and classified; a method of altering the shape of the particles obtained by the kneading and grinding method using mechanical shock or heat energy; an emulsion polymerization aggregation method in which a dispersion solution obtained by emulsifying and polymerizing polymerizable monomers of a binding resin is mixed with a dispersion solution containing a coloring agent, a releasing agent, and optionally a charge control agent and other agents, then aggregated, heated, and fused to obtain toner particles; a suspension polymerization method in which polymerizable monomers to obtain a binding resin and a solution containing a coloring agent, a releasing agent, and optionally a charge control agent and other agents, are suspended in an aqueous solvent and polymerized therein; and a dissolution-suspension method in which a binding resin and a solution containing a coloring agent, a releasing agent, and optionally a charge control agent and other agents, is suspended in an aqueous solvent to form particles.

Moreover, known methods such as a method of producing toner particles having a core-shell structure in which aggregated particles are further attached to the toner particles obtained by the above-described method, as the core, then heated and fused. As the method of producing toner particles, a suspension-polymerization method, an emulsion polymerization aggregation method, and a dissolution suspension method carried out in an aqueous solvent are preferred, and an emulsion polymerization aggregation method is most preferred from the viewpoint of controlling the shape and particle diameter distribution.

Toner mother particles comprise a binding resin, a coloring agent and a releasing agent, and as appropriate, further comprise silica and a charge control agent.

Examples of the binding resins used in the toner mother particles include monopolymers and copolymers of styrenes such as styrene and chlorostyrene, monoolefins such as ethylene, propylene, butylene, and isoprene, vinyl esters such as vinyl acetate, vinyl propionate, vinyl benzoate, vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone, and polyester resins synthesized by copolymerization of dicarboxylic acids and diols.

Examples of the typical binding resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and polyester resins. Other examples include polyurethane, epoxy resins, silicone resins, polyamide, modified rosin and paraffin wax.

Examples of the typical coloring agents include magnetic powder such as magnetite and ferrite, carbon black, aniline blue, chalcoyl blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Examples of the typical releasing agents include low-molecular polyethylene, low-molecular polypropylene, Fischer-Tropsch wax, montan wax, carnauba wax, rice wax and candelilla wax.

As the charge control agent, known agents such as azo metal-complex compounds, metal-complex compounds of salicylic acid, and resin-type charge control agents having polar groups can be used. When toner particles are produced by a wet method, it is preferred to use materials hardly soluble in water from the viewpoint of controlling ion strength and reducing contamination by waste water. The toner may be either a magnetic toner which contains a magnetic material or a non-magnetic toner which contains no magnetic material.

The toner particles used in the developing device 11 can be produced by mixing the above-described toner mother particles and external additives using a Henschel mixer, a V blender or the like.

When the toner mother particles are produced by a wet process, external additives can be added by a wet method.

Lubricant particles may be added to the toner used in the developing device 11. Examples of the lubricant particles include solid lubricants such as graphite, molybdenum disulfide, talc, fatty acids and metal salts of fatty acids, low molecular weight polyolefins such as polypropylene, polyethylene and polybutene, silicones having a softening point by heating, fatty-acid amides such as oleic acid amide, erucic acid amide, ricinoleic acid amide and stearic acid amide, vegetable waxes such as carnauba wax, rice wax, candelilla wax, Japan wax and jojoba oil, animal waxes such as beeswax, mineral and petroleum waxes such as montan wax, ozokerite, ceresine, paraffin wax, microcrystalline wax and Fischer-Tropsch wax, and modified products thereof. These may be used alone or in combination of two or more kinds thereof. The average particle diameter is preferably in the range of 0.1 to 10 μm, and those having the above-described chemical structure may be ground into particles having the same particle diameter. The content of the particles in the toner is preferably in the range of 0.05 to 2.0% by weight, more preferably 0.1 to 1.5% by weight.

Inorganic particles, organic particles or composite particles to which inorganic particles are attached to the organic particles may be added to the toner particles used in the developing device 11 for the purpose of removing a deposition or a deterioration-inducing substance from the surface of an electrophotographic photoreceptor.

Examples of the appropriate inorganic particles include various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The above-described inorganic particles may be treated with titanium coupling agents such as tetrabutyl titanate, tetraoctyl titanate, isopropyltriisostearyl titanate, isopropyltridecylbenzenesulfonyl titanate and bis(dioctylpyrophosphate)oxyacetate titanate, silane coupling agents such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane.

The above-described particles hydrophilized with metal salts of higher fatty acids such as silicone oil, stearic acid aluminum, stearic acid zinc and stearic acid calcium are also preferably used.

Examples of the organic particles include styrene resin particles, styrene acrylic resin particles, polyester resin particles and urethane resin particles.

The particle diameter based on the number average particle diameter is preferably 5 nm to 1000 nm, more preferably 5 nm to 800 nm, further preferably 5 nm to 700 nm. If the average particle diameter is less than the lower limit, the particles tend to have insufficient abrasive properties. On the other hand, if the average particle diameter exceeds the upper limit, the particles tend to scratch the surface of an electrophotographic photoreceptor. The total of the content of the above-described particles and lubricant particles is preferably 0.6% by weight or more.

As the other inorganic oxides added to the toner articles, small inorganic oxide particles having a primary diameter of 40 nm or less are preferably used from the viewpoint of powder mobility and charge control, and inorganic oxide particles having a larger diameter than that of the small inorganic oxide particles are preferably added from the viewpoint of adhesiveness reduction and charge control. Known inorganic oxide particles may be used, but the combination of silica and titanium oxide particles is preferred for precise charge control.

Surface treatment of small inorganic particles enhances the dispersibility and powder mobility of the particles. Furthermore, the addition of carbonates such as calcium carbonate and magnesium carbonate, and inorganic minerals such as hydrotalcite is also preferably used to remove discharge products.

Color toner particles for electrophotography are used in combination with carriers. Examples of the carrier include iron powder, glass beads, ferrite powder, nickel powder and those coated with a resin. The mixing ratio of the carriers can be determined as appropriate.

Examples of the transfer device 40 include known transfer charging devices such as a contact type transfer charging devices using a belt, a roller, a film, a rubber blade, a scorotron transfer charging device and a corotron transfer charging device utilizing corona discharge.

As the intermediate transfer body 50, a belt which is imparted semiconductivity (intermediate transfer belt) of polyimide, polyamide imide, polycarbonate, polyarylate, polyester, rubber or the like is used. The intermediate transfer body 50 may also take the form of a drum.

In addition to the above-described devices, the image forming apparatus 100 may further be provided with, for example, a photodischarge device for photodischarging the photoreceptor 7.

Figure 5:
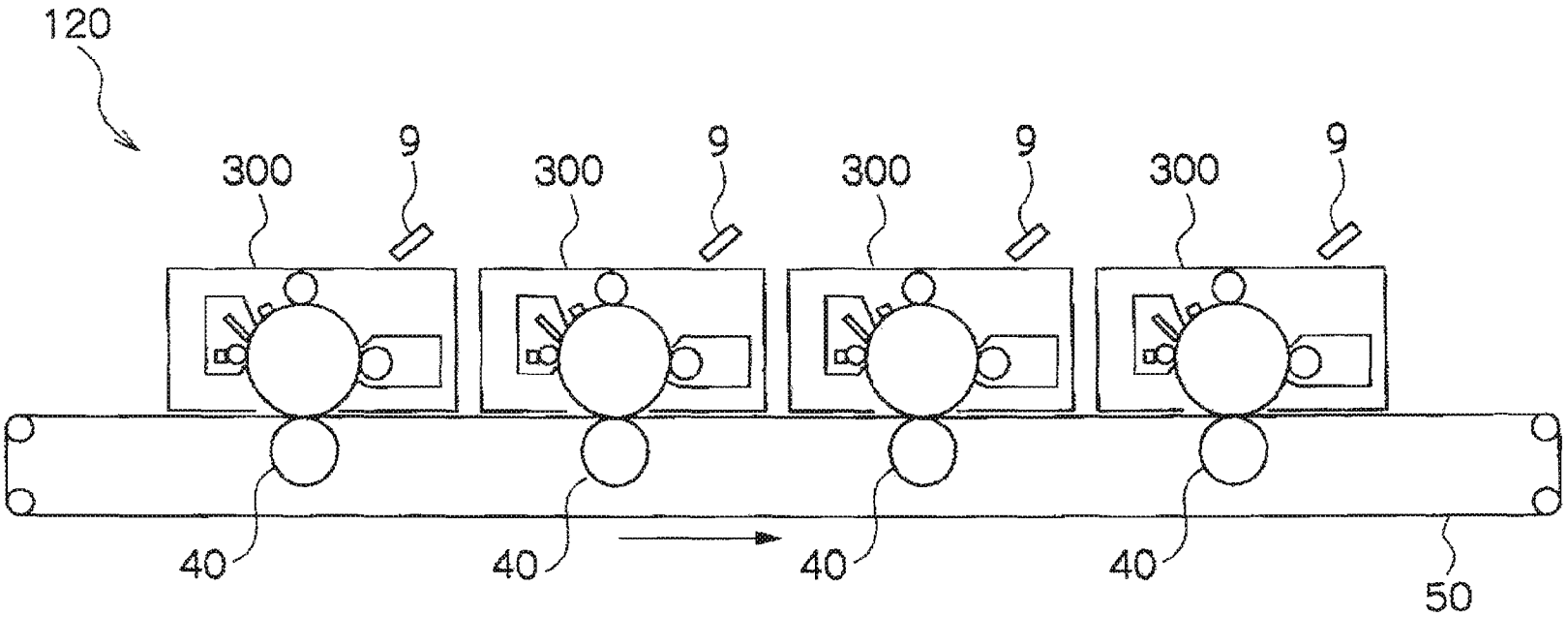
FIG. 5 is a schematic block diagram showing an image forming apparatus according to another exemplary embodiment of the invention.

FIG. 5 is a schematic block diagram showing an image forming apparatus according to another exemplary embodiment of the invention. As shown in FIG. 5, the image forming apparatus 120 is a full color image forming apparatus of tandem type including four process cartridges 300. In the image forming apparatus 120, four process cartridges 300 are disposed parallel with each other on the intermediate transfer body 50, and one electrophotographic photoreceptor can be used for one color. The image forming apparatus 120 has the same constitution as the image forming apparatus 100, except being tandem type.

When the electrophotographic photoreceptor of the invention is used in a tandem type image forming apparatus, the electrical characteristics of the four photoreceptors are stabilized, which provides high image quality with excellent color balance over the long time.

In the image forming apparatus (process cartridge) according to an exemplary embodiment of the invention, the development apparatus (development unit) preferably includes a development roller as a developer retainer which moves (rotates) in the direction opposite to the traveling direction (rotation direction) of the electrophotographic photoreceptor. For example, the development roller has a cylindrical development sleeve for retaining the developer on the surface thereof, and the development apparatus has a control member for controlling the amount of the developer fed to the development sleeve. When the development roller of the development apparatus is moved (rotated) in the direction opposite to the rotation direction of the electrophotographic photoreceptor, the surface of the electrophotographic photoreceptor is rubbed with the toner retained between the development roller and the electrophotographic photoreceptor. It is considered that the rubbing operation and the deposit removal performance improved by the crosslinked product composed of the guanamine compound and the specific charge transporting material (in particular, the material providing a highly crosslinked cured film through the increase of the number of the reactive functional groups) improves removability of the discharge products (in particular, low-resistance substances derived from ozone and NOx) from the surface of the electrophotographic photoreceptor, and deposit of the discharge products is prevented over the very long term. As a result of this, it is considered that the occurrence of image quality defects such as resolution deterioration, streaks, and image blurring inherent in a photoreceptor having high wear resistance is prevented, and higher quality image and higher life are achieved at a higher level. It is also considered that the prevention of deposit of discharge products allows maintenance of the excellent lubricity of the electrophotographic photoreceptor surface over the long term. As a result of this, the occurrence of scarfing of the cleaning blade or unusual sounds is sufficiently prevented, and a high level of cleaning performance is maintained over the long term. In addition, in the image forming apparatus (process cartridge) according to an exemplary embodiment of the invention, from the viewpoint of preventing deposit of discharge products over the longer term, the space between the development sleeve and the photoreceptor is preferably 200 μm or more and 600 μm or less, and more preferably 300 μm or more and 500 μm or less. From the same viewpoint, the space between the development sleeve and control blade, which is a control member for controlling the amount of the developer, is preferably 300 μm or more and 1000 μm or less, and more preferably 400 μm or more and 750 μm or less. From the viewpoint of preventing deposit of discharge products over the longer term, the absolute moving velocity of the development roll surface (process speed) is preferably from 1.5 times to 2.5 times, and more preferably from 1.7 times to 2.0 times the moving velocity of the photoreceptor surface.

In the image forming apparatus (process cartridge) according to an exemplary embodiment of the invention, the development apparatus (development unit) includes a developer retainer having a magnetic substance, and develops an electrostatic latent image with preferably a two-component developer containing a magnetic carrier and a toner. With the structure, finer color images are produced, and higher quality and longer life are achieved in comparison with other structure using a one-component developing solution, particularly a non-magnetic one-component developer.

EXAMPLES

The invention will now be illustrated in more detail with reference to examples. However, the invention is not limited to the examples.

<Guanamine Resin (G-1)>

500 parts by weight of SUPER BECKAMIN (R) L-148-55 (butyrated benzoguanamine resin manufactured by Dainippon Ink And Chemicals, Incorporated) containing the structure A-15 is dissolved in 500 parts by weight of xylene, and washed with 300 ml portions of distilled water five times. The final washing water has a conductivity of 6 μS/cm. The solvent is removed by evaporation under reduced pressure, and thus 250 parts by weight of a jelly-like resin are obtained. The resin is used as guanamine resin G-1.

The conductivity of the washing water is measured at room temperature (about 20° C.) using a direct conductivity meter (trade name: Conductivity Meter DS-12; manufactured by Horiba, Ltd.).

<Guanamine Resin (G-2)>

500 parts by weight of SUPER BECKAMIN (R) 13-535 (methylated benzoguanamine resin manufactured by Dainippon Ink And Chemicals, Incorporated) containing the structure A-14 is dissolved in 500 parts by weight of xylene, and washed with 300 ml portions of distilled water five times. The final washing water has a conductivity of 7 μS/cm. The solvent is removed by evaporation under reduced pressure, and thus 270 parts by weight of a jelly-like resin are obtained. The resin is used as guanamine resin G-2.

<Guanamine Resin (G-3)>

500 parts by weight of SUPER BECKAMIN (R) L-148-55 (butyrated benzoguanamine resin manufactured by Dainippon Ink And Chemicals, Incorporated) containing the structure A-15 is dissolved in 500 parts by weight of xylene. To the solution, 20 parts by weight of an ion exchange resin (trade name: AMBERITE 15; manufactured by Rohm and Haas) and 20 parts by weight of an anion exchange resin (trade name: AMBERITE IRA-400; manufactured by Rohm and Haas) are added, stirred for 20 minutes, and then the ion exchange resin is removed by filtration. To 10 parts by weight of the solution, 10 parts by weight of distilled water are added and stirred, and allowed to stand. The separated aqueous phase has a conductivity of 3 μS/cm. The solvent is removed by evaporation under reduced pressure, and thus 250 parts by weight of a jelly-like resin are obtained. The resin is used as guanamine resin G-3.

<Guanamine Resin (G-4)>

SUPER BECKAMIN, (R) L-148-55 containing the structure A-15 is used as guanamine resin G-4.

<Guanamine Resin (G-5)>

SUPER BECKAMIN (R)13-535 containing the structure A-14 is used as guanamine resin G-5.

<Guanamine Resin (G-6)>

NIKALACK BL-60 (manufactured by Nippon Carbide Industries Co., Inc.) containing the structure A-17 is used as guanamine resin G-6. The resin contains about 37% by weight of a xylene-based solvent.

<Catalyst-1>

Paratoluenesulfonic acid is used as catalyst-1.

<Catalyst-2>

NACURE 2501 (manufactured by King Industry) is used as catalyst-2.

<Catalyst-3>

NACURE 5225 (manufactured by King Industry) is used as catalyst-3.

<Catalyst-4>

NACURE 4167 (manufactured by King Industry) is used as catalyst-4.

Example 1

An electrophotographic photoreceptor is made as described below.

(Preparation of Undercoating Layer)

100 parts by weight of zinc oxide (average particle diameter: 70 nm, manufactured by Tayca Corporation, specific surface area: 15 $m^2/g$) is stirred and mixed with 500 parts by weight of toluene, into which 1.3 parts by weight of a silane coupling agent (trade name: KBM503, manufactured by Shin-Etsu Chemical Co., Ltd.) is added and stirred for 2 hours. Subsequently, toluene is removed by distillation under reduced pressure, and baking is carried out at a temperature of 120° C. for 3 hours to obtain the zinc oxide having the surface treated with the silane coupling agent.

110 parts by weight of the surface-treated zinc oxide is stirred and mixed with 500 parts by weight of tetrahydrofuran, into which a solution in which 0.6 parts by weight of alizarin is dissolved in 50 parts by weight of tetrahydrofuran is added, then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, trade name: Sumidur 3175, manufactured by Sumitomo-Bayer Urethane Co., Ltd.) and 15 parts by weight of a butyral resin (trade name: S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with the glass beads having a diameter of 1 mm for 2 hours to obtain a dispersion.

0.005 parts by weight of dioctyltin dilaurate as a catalyst, and 40 parts by weight of silicone resin particles (trade name: Tospal 145, manufactured by GE Toshiba Silicone Co., Ltd.) are added to the dispersion to obtain a coating solution for a undercoating layer. A undercoating layer having a thickness of 18 μm is formed by applying the coating solution on an aluminum substrate having a diameter of 30 mm, a length of 340 mm and a thickness of 1 mm by dip coating, and drying to cure at a temperature of 170° C. for 40 minutes.

(Preparation of Charge Generating Layer)

A mixture comprising 15 parts by weight of hydroxy gallium phthalocyanine having the diffraction peaks at least at 7.3°, 16.0°, 24.9° and 28.0° of Bragg angles (2θ±0.2°) in an X-ray diffraction spectrum of Cukα X ray as a charge generating substance, 10 parts by weight of vinyl chloride-vinyl acetate copolymer resin (trade name: VMCH, manufactured by Nippon Unicar Co., Ltd.) as a binding resin, and 200 parts by weight of n-butyl acetate is dispersed using a sand mill with the glass beads of 1 mm diameter for 4 hours. 175 parts by weight of n-butyl acetate and 180 parts by weight of methyl ethyl ketone are added to the obtained dispersion, then stirred to obtain a coating solution for a charge generating layer. The coating solution for charge generating layer is applied to the undercoating layer by dip coating, and dried at an ordinary temperature (25° C.) to form a charge generating layer having a film thickness of 0.2 μm.

(Preparation of Charge Transporting Layer)

45 parts by weight of N,N'-diphenyl-N,N'-bis(3-methylphenyl)-[1,1']biphenyl-4,4'-diamine and 55 parts by weight of bisphenol Z polycarbonate resin (viscosity average molecular weight: 40,000) are dissolved in 800 parts by weight of chlorobenzene to obtain a coating solution for a charge transporting layer. The coating solution is applied onto the charge generating layer, then dried at a temperature of 130° C. for 45 minutes to form a charge transporting layer having a film thickness of 15 μm.

(Preparation of Protective Layer)

3 parts by weight of the guanamine resin G-1, 3 parts by weight of the compound represented by the formula (I-2), 0.3 parts by weight of colloidal silica (trade name: PL-1, manufactured by Fuso Chemical Co., Ltd.), 0.2 parts by weight of a polyvinyl phenolic resin (weight average molecular weight: about 8000, manufactured by Aldrich), 8 parts by weight of 1-methoxy-2-propanol, 0.2 parts by weight of 3,5-di-t-butyl-4-hydroxytoluene (BHT), and 0.01 parts by weight of p-toluenesulfonic acid are mixed to prepare a protective layer coating solution. The beating solution is applied to the charge transporting layer by dip coating, air-dried at room temperature (25° C.) for 30 minutes, and then heated at 150° C. for 1 hour for curing. Thus, a protective layer having a film thickness of about 7 μm is formed, and a photoreceptor of Example 1 is obtained.

During immersion of the photoreceptor having the charge transporting layer in the protective layer coating solution for 1 hour, N,N'-diphenyl-N,N'-bis(3-methylphenyl)-[1,1']biphenyl-4,4'-diamine is not eluted from the protective layer coating solution.

[Image Quality Evaluation]

The electrophotographic photoreceptor made as described above is mounted on DocuCentre Color 400CP manufactured by Fuji Xerox Co., Ltd., and continuously subjected to the following evaluations under low temperature and low humidity (8° C., 20% RH), and high temperature and high humidity (28° C., 85% RH). The developing device is configured in such a manner that the traveling directions of the developer roll (developer retainer) and the electrophotographic photoreceptor are the same at the sliding portion (hereinafter may be referred to as "with system"). More specifically, image formation test is conducted by continuously forming a halftone image having an image density of 10% on 5000 sheets at low temperature and low humidity (8° C., 20% RH). After the image formation test on 5000 sheets the photoreceptor is allowed to stand at low temperature and low humidity (8° C., 20% RH) for 24 hours. The quality of the image printed immediately after the image formation test on 5000 sheets, and the first image printed after the standing is evaluated on ghosts, fogging, streaks, and image degradation. The results are shown in Table 2.

Following the image quality evaluation at low temperature and low humidity, another image formation test is conducted by continuously forming a halftone image having an image density of 10% on 5000 sheets at high temperature and high humidity (28° C., 85% RH). After the image formation test on 5000 sheets, the photoreceptor is allowed to stand at high temperature and high humidity (28° C., 85% RH) for 24 hours. The quality of the image printed immediately after the image formation test on 5000 sheets, and the first image printed after the standing is evaluated on ghosts, fogging, streaks, and image degradation. The results are shown in Table 3.

PE paper (A3 size) manufactured by Fuji Xerox Office Supply is used for the image formation tests.

(Ghost Evaluation)

<Ghosts>

Figure 6A:
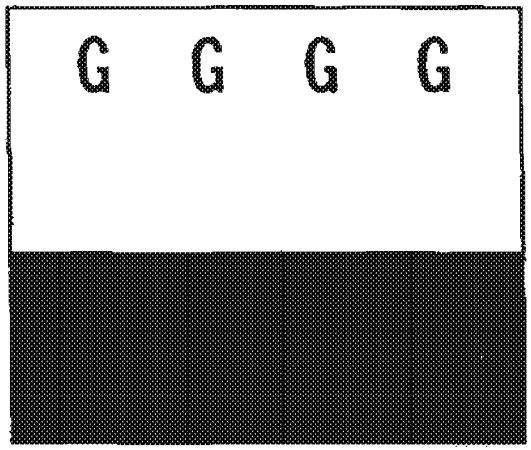
FIG. 6A is an explanatory drawing showing the criteria of ghost evaluation.

For ghost evaluation, patterns each having G characters and a black region as shown FIG. 6A are printed, and the appearance of the G characters in the black region is visually observed.

A: Absence to slight as shown in FIG. 6A.

Figure 6B:
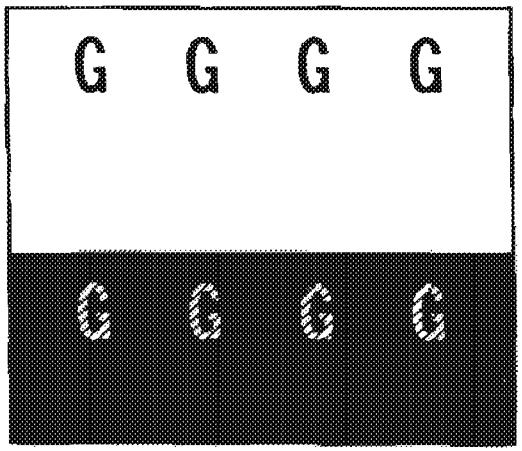
FIG. 6B is an explanatory drawing showing the criteria of ghost evaluation.

B: Slightly apparent as shown in FIG. 6B.

Figure 6C:
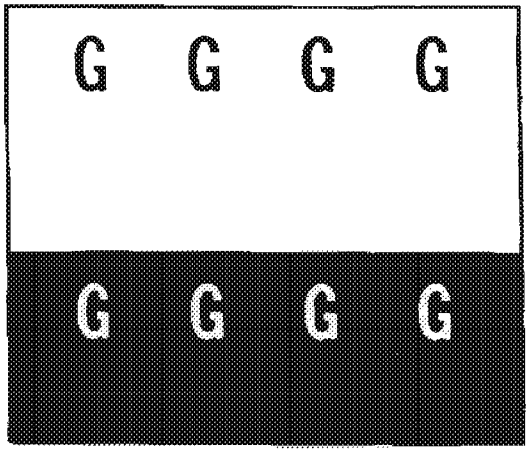
FIG. 6C is an explanatory drawing showing the criteria of ghost evaluation.

C: Noticeable as shown in FIG. 6C.

<Fogs>

The degree of toner adhesiveness to the white area is evaluated by visual observation using the same sample with the evaluation of ghost.

A: Good.

B: Light fog is developed.

C: Fog having a damaging effect of image quality is developed.

<Streaks>

Development of streaks is evaluated by visual observation using the same sample with the evaluation of ghost.

A: Good.

B: Streaks are partially developed.

C: Streaks having a damaging effect on image quality are developed.

(Image Degradation Evaluation)

<Image Degradation>

The same sample as that used for the ghost evaluation is used for the image degradation evaluation. In the image formation test is conducted at low temperature and low humidity, and at high temperature and high humidity, and the density deterioration in the black region is evaluated on the basis of visual observation.

A: Good.

B: No problem during continuous printing, but image degradation occurs after standing for 24 hours.

C: Image degradation occurs during continuous printing.

[Protective Layer Adhesiveness Evaluation]

Adhesiveness of the protective layer is evaluated as follows. A total of 25 (5×5) squares measuring 2 mm per side are cut on the photoreceptor after the image formation test with a cutter knife, to which a mending tape produced by 3M is attached, and then the tape is removed at an angle of 90° to the adhesion surface. The adhesiveness is evaluated in terms of the number of the remaining squares. The result is shown in Table 2.

A: 21 or more squares remain.

B: 11 to 20 squares remain.

C: 10 or less squares remain.

[Torque Measurement]

The electrophotographic photoreceptor made as described above is mounted on DocuCentre Color 400CP manufactured by Fuji Xerox Co., Ltd., and full size images of respective colors having an image density of 20% are printed. Subsequently, the drum cartridge is taken out, a manual torque gauge (trade name: BTG90CN-S, manufactured by TOHNICHI Mfg, Co., Ltd.) is attached to the photoreceptor in the drum cartridge. The torque gauge is moved from the resting state to the rotating state, while the maximum torque is measured three times at low temperature and low humidity (8° C., 20% RH), and the average is regarded as the torque of the photoreceptor. The result is shown in Table 2.

Examples 2 Through 13

Photoreceptors of Examples 2 through 13 are made in the same manner as Example 1 except that the kind and amount of the guanamine resin (the compound represented by the formula (A)), charge transporting material (the compound represented by the formula (I)), additive, and catalyst are changed according to Table 1, and evaluated in the same manner as Example 1. The results are shown in Tables 2 and 3.

Example 14

A photoreceptor of Example 14 having a protective layer is made in the same manner as Example 1 except that the charge transporting layer is formed as described below, and evaluated in the same manner as Example 1. The results are shown in Tables 2 and 3.

(Preparation of Charge Transporting Layer)

45 parts by weight of the following compound (a) and 55 parts by weight of bisphenol Z polycarbonate resin (viscosity average molecular weight: 40,000) are dissolved in 800 parts by weight of chlorobenzene to obtain a coating solution for charge transporting layer. The coating solution is applied to the charge generating layer, and dried at a temperature of 130° C. for 45 minutes to form a charge transporting layer having a film thickness of 17 μm.

Compound (α)

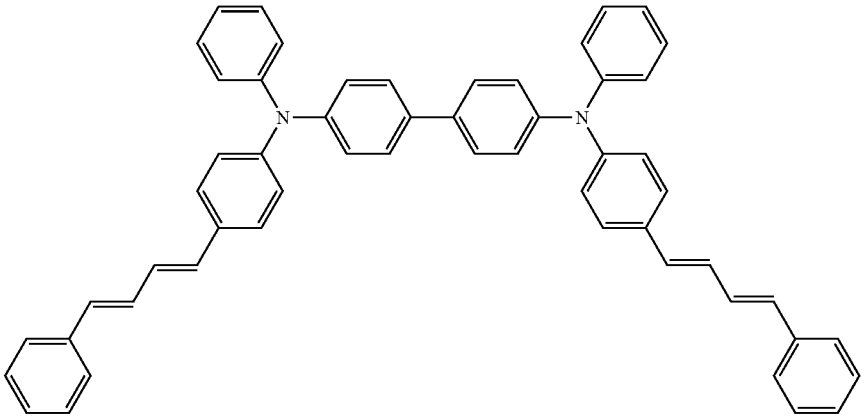

Example 15

A photoreceptor 15 having a protective layer is prepared in the same manner as Example 1, except that the charge transporting layer is formed in accordance with the method as described below. The evaluation is made in the same manner as the other examples. The results are shown in Tables 2 and 3.

(Preparation of a Charge Transporting Layer)

50 parts by weight of the following compound (β) and 50 parts by weight of bisphenol Z polycarbonate resin (viscosity average molecular weight: 50,000) are dissolved in 800 parts by weight of chlorobenzene to obtain a coating solution for charge transporting layer. The coating solution is applied onto the charge generating layer, and dried at a temperature of 130° C. for 45 minutes to form a charge transporting layer having a film thickness of 15 μm.

Compound (β)

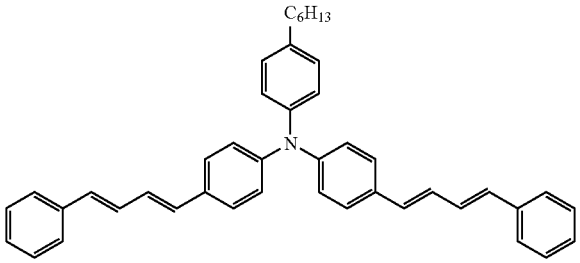

Example 16

A photoreceptor 16 having a protective layer is prepared in the same manner as Example 1, except that the charge transporting layer is formed in accordance with the method as described below. The evaluation is made in the same manner as the other examples. The results are shown in Tables 2 and 3.

(Preparation of a Charge Transporting Layer)

50 parts by weight of the following compound (γ) and 50 parts by weight of bisphenol Z polycarbonate resin (viscosity average molecular weight: 80,000) are dissolved in 800 parts by weight of chlorobenzene to obtain a coating solution for a charge transporting layer. The coating solution is applied onto the charge generating layer, and dried at 130° C. for 45 minutes to form a charge transporting layer having a film thickness of 15 μm.

Compound (γ)

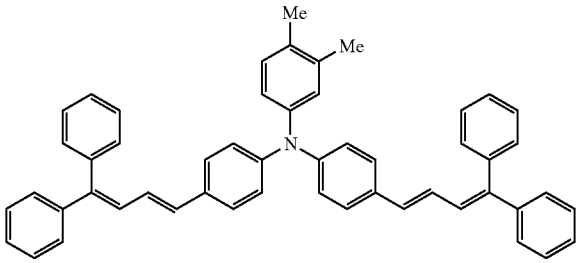

Examples 17 Through 23

Photoreceptors of Examples 17 through 23 are made in the same manner as Example except that the kind and amount of the guanamine resin (the compound represented by the formula (A)), charge transporting material (the compound represented by the formula (I)), additive, and catalyst are changed according to Table 1, and evaluated in the same manner as Example 1. The results are shown in Tables 2 and 3.

Comparative Examples 1 Through 4

Photoreceptors of Comparative Examples 1 through 4 are made in the same manner as Examples 1, 14, 15, and 16 except that no protective layer is formed, and evaluated in the same manner as Example 1. The results are shown in Tables 2 and 3.

Comparative Examples 5 Through 7

A solution composed of 60 parts by weight of a powder composed of conductive particles coated with antimony-doped tin oxide (trade name: S-1, manufactured by Mitsubishi Materials Corporation), 30 parts by weight of titanium oxide (trade name: TITONE R-1T, manufactured by Sakai Chemical Industry Co., Ltd.), 60 parts by weight of a resole type phenolic resin (trade name: PHENOLITE J-325, manufactured by Dainippon Ink And Chemicals, Incorporated, solid content: 70% by weight), 50 parts by weight of 2-methoxy-1-propanol, and 50 parts by weight of methanol is dispersed for about 20 hours with a ball mill. The dispersion is applied to each of the charge transporting layers of Examples 1, 15, and 16 to form protective layers having a film thickness of 5 μm. Thus photoreceptors of Comparative Examples 5 through 8 are made, and evaluated in the same manner as Example 1. The results are shown in Tables 2 and 3.

Comparative Example 8

6 parts by weight of the following compound (Δ), 7 parts by weight of the guanamine resin G-6, 0.5 parts by weight of a butyral resin(trade name: S-Lec BM-1, manufactured by Sekisui Chemical Co., Ltd.), 0.5 parts by weight of bisglycidyl bisphenol A, 0.5 parts by weight of biphenyltetracarboxylic acid, 0.03 parts by weight of methylphenylpolysiloxane, and 0.2 parts by weight of antioxidant (SANOL LS 2626 manufactured by Sankyo Lifetech Co., Ltd) are dissolved in 7 parts by weight of isopropanol. In the same manner as Example 1, the coating solution is applied to the charge transporting layer by dip coating, air-dried at room temperature for 30 minutes, and then heated at 150° C. for 1 hour for curing. Thus, a protective layer having a film thickness of about 7 μm is formed, and a photoreceptor of Comparative Example 8 is obtained, and evaluated in the same manner as Example 1. The results are shown in Tables 2 and 3. The photoreceptor of Comparative Example 8 is subjected to image formation test by printing 10000 sheets at high temperature and high humidity (28° C., 85% RH), and then observed for the surface conditions; scratch-like peeling of the surface layer is observed. After immersion of the photoreceptor having the charge transporting layer in the protective layer coating solution for 1 hour, the protective layer coating solution is irradiated with ultraviolet light (356 nm); a blue color fluorescence is observed because N,N'-diphenyl-N,N'-bis(3-methyl phenyl)-[1,1']biphenyl-4,4'-diamine is eluted to the protective layer coating solution.

Compound (A)

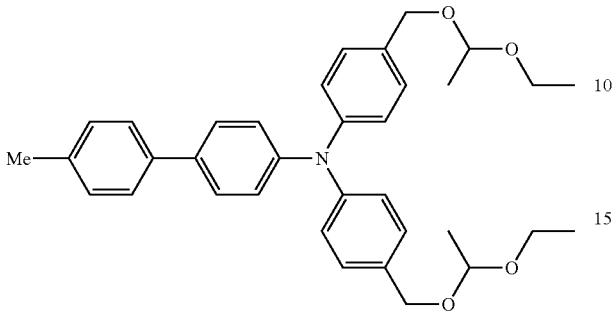

Examples 24 Through 27

The electrophotographic photoreceptors are the same as those made in Examples 1, 9, 13, and 23. The evaluation apparatus is a modification of DocuCentre Color 400CP manufactured by Fuji Xerox Co., Ltd., wherein the developing device is configured in such a manner that the traveling directions of the developer roll (developer retainer) and the electrophotographic photoreceptor are opposite (hereinafter may be referred to as "against system") at the sliding portion. The peripheral speed of the development roll is set at 182 mm/sec (1.75 times the process speed), and the space between the development roll and the control blade is adjusted such that the amount of the developer per unit area of the development roll under the against system is the same as that under the with system. The same test as Example 1 is conducted with the structure, and the obtained results are shown in Tables 2 and 3.

TABLE 1

| | | | Additives | | | |
|---|---|---|---|---|---|---|
| | Charge transporting material/amount | Guanamine resin/amount | Particles/amount | Resin/amount | Antioxidant/amount | Catalyst |
| Example 1 | I-2/3 parts by weight | G-1/3 parts by weight | PL-1/0.3 parts by weight | Polyvinyl phenol resin/0.2 parts by weight | BHT/0.2 parts by weight | 1 |
| Example 2 | I-4/3 parts by weight | G-2/3 parts by weight | S-1/0.3 parts by weight | Butyral resin (BM-1)/0.2 parts by weight | BHT/0.2 parts by weight | 1 |
| Example 3 | I-3/3 parts by weight | G-3/3 parts by weight | PTFE/0.3 parts by weight | — | SANOL LS770/0.2 parts by weight | 2 |
| Example 4 | I-8/3 parts by weight | G-4/3 parts by weight | PL-1/0.3 parts by weight | — | BHT/0.2 parts by weight | 2 |
| Example 5 | I-9/3 parts by weight | G-6/3 parts by weight | PL-1/0.3 parts by weight | — | BHT/0.2 parts by weight | 3 |
| Example 6 | I-16/3 parts by weight | G-2/3 parts by weight | S-1/0.3 parts by weight | — | SANOL LS770/0.2 parts by weight | 3 |
| Example 7 | I-23/3 parts by weight | G-5/3 parts by weight | S-1/0.3 parts by weight | — | SANOL LS770/0.2 parts by weight | 3 |
| Example 8 | I-25/3 parts by weight | G-1/3 parts by weight | PL-1/0.3 parts by weight | Polyvinyl phenol resin/0.2 parts by weight | BHT/0.2 parts by weight | 4 |
| Example 9 | I-20/3 parts by weight | G-1/3 parts by weight | PL-1/0.3 parts by weight | Polyvinyl phenol resin/0.2 parts by weight | — | 4 |
| Example 10 | I-5/3 parts by weight | G-1/3 parts by weight | PL-1/0.3 parts by weight | Polyvinyl phenol resin/0.2 parts by weight | BHT/0.2 parts by weight | 1 |
| Example 11 | I-8/3 parts by weight | G-1/3 parts by weight | PL-1/0.3 parts by weight | Butyral resin (BM-1)/0.2 parts by weight | BHT/0.2 parts by weight | 2 |
| Example 12 | I-9/3 parts by weight | G-6/3 parts by weight | PL-1/0.3 parts by weight | — | SANOL LS770/0.2 parts by weight | 2 |
| Example 13 | I-16/3 parts by weight | G-3/3 parts by weight | S-1/0.3 parts by weight | — | SANOL LS770/0.2 parts by weight | 3 |
| Example 14 | I-23/3 parts by weight | G-5/3 parts by weight | PL-1/0.3 parts by weight | — | SANOL LS770/0.2 parts by weight | 3 |
| Example 15 | I-25/3 parts by weight | G-6/3 parts by weight | PL-1/0.3 parts by weight | Polyvinyl phenol resin/0.2 parts by weight | BHT/0.2 parts by weight | 4 |
| Example 16 | I-20/3 parts by weight | G-5/3 parts by weight | PL-1/0.3 parts by weight | Polyvinyl phenol resin/0.2 parts by weight | — | 4 |
| Example 17 | I-10/3 parts by weight | G-1/3 parts by weight | — | — | BHT/0.2 parts by weight | 1 |
| Example 18 | I-11/3 parts by weight | G-1/1 parts by weight | — | — | BHT/0.2 parts by weight | 1 |
| Example 19 | I-21/3 parts by weight | G-2/0.5 parts by weight | — | — | BHT/0.2 parts by weight | 3 |
| Example 20 | I-27/3 parts by weight | G-1/3 parts by weight | S-1/0.3 parts by weight | Polyvinyl phenol resin/0.2 parts by weight | — | 2 |

TABLE 1-continued

| | Charge transporting material/amount | Guanamine resin/amount | Additives | | | |
|---|---|---|---|---|---|---|
| | | | Particles/amount | Resin/amount | Antioxidant/amount | Catalyst |
| Example 21 | I-30/3 parts by weight | G-1/3 parts by weight | S-1/0.3 parts by weight | Polyvinyl phenol resin/0.2 parts by weight | — | 1 |
| Example 22 | I-33/3 parts by weight | G-1/3 parts by weight | S-1/0.3 parts by weight | Phenol resin/0.2 parts by weight | — | 2 |
| Example 23 | I-30/3 parts by weight | G-1/1 parts by weight | PL-1/0.3 parts by weight | Melamine resin/1 part by weight | BHT/0.2 parts by weight | 1 |

In Table 1, S-1 refers to conductive particles coated with antimony-doped tin oxide manufactured by Mitsubishi Materials Corporation (trade name: S-1), PTFE refers to PTFE particles manufactured by Daikin Industries, Ltd (trade name: LUBRON L-2), the butyral resin (BM-1) refers to a butyral resin manufactured by Sekisui Chemical Co., Ltd. (trade name: S-LEC BM-1), and SANOL LS770 refers to an antioxidant manufactured by Sankyo Lifetech Co., Ltd. (trade name: SANOL LS770). The phenolic resin refers to PL-4852 manufactured by Gun Ei Chemical Co., Ltd., and the melamine resin refers to MW-30 manufactured by Sanwa Chemical Co., Ltd.

TABLE 2

| | | | Low temperature and low humidity (8° C., 20% RH) | | | | | | | |
|---|---|---|---|---|---|---|---|---|---|---|
| | | | After printing on 10000 sheets at low temperature and low humidity | | | | After standing one day at low temperature and low humidity | | | |
| | Adhesiveness | Torque (cN · m) | Ghost | Fogging | Streak | Image degradation | Ghost | Fogging | Streak | Image degradation |
| Example 1 | A | 43 | A | A | B | A | A | A | B | A |
| Example 2 | A | 40 | A | A | B | A | A | A | B | A |
| Example 3 | A | 41 | A | A | B | A | A | A | B | A |
| Example 4 | A | 35 | A | A | A | A | A | A | B | A |
| Example 5 | A | 36 | A | A | A | A | A | A | B | A |
| Example 6 | A | 29 | A | A | A | A | A | A | A | A |
| Example 7 | A | 38 | A | A | A | A | A | A | B | A |
| Example 8 | A | 31 | A | A | A | A | A | A | B | A |
| Example 9 | A | 27 | A | A | A | A | A | A | B | A |
| Example 10 | A | 47 | A | A | B | A | A | A | B | A |
| Example 11 | A | 39 | A | A | A | A | A | A | B | A |
| Example 12 | A | 36 | A | A | A | A | A | A | B | A |
| Example 13 | B | 28 | A | A | A | A | A | A | B | A |
| Example 14 | A | 36 | A | A | A | A | A | A | B | A |
| Example 15 | A | 32 | A | A | A | A | A | A | A | A |
| Example 16 | A | 28 | A | A | A | A | A | A | A | A |
| Example 17 | A | 32 | A | A | B | A | A | A | B | A |
| Example 18 | A | 34 | A | A | A | A | A | A | B | A |
| Example 19 | A | 30 | A | A | B | A | A | A | B | A |
| Example 20 | A | 33 | A | A | A | A | A | A | B | A |
| Example 21 | A | 31 | A | A | A | A | A | A | B | A |
| Example 22 | A | 29 | A | A | B | A | A | A | B | A |
| Example 23 | A | 25 | A | A | B | A | A | A | B | A |
| Example 24 | A | — | A | A | A | A | A | A | A | A |
| Example 25 | A | — | A | A | A | A | A | A | A | A |
| Example 26 | B | — | A | A | A | A | A | A | A | A |
| Example 27 | A | — | A | A | A | A | A | A | A | A |
| Comparative example 1 | — | 23 | A | A | A | A | A | A | A | A |
| Comparative example 2 | — | 20 | A | A | A | A | A | A | A | A |
| Comparative example 3 | — | 24 | A | A | A | A | A | A | A | A |
| Comparative example 4 | — | 25 | A | A | A | A | A | A | A | A |
| Comparative example 5 | B | 30 | A | B | A | A | A | B | A | A |
| Comparative example 6 | B | 32 | A | B | A | A | A | B | A | A |
| Comparative example 7 | B | 31 | A | B | A | A | A | B | A | A |
| Comparative example 8 | A | 35 | A | A | A | A | A | A | A | A |

TABLE 3

| | High temperature and high humidity (28° C., 85% RH) | | | | | | | |
|---|---|---|---|---|---|---|---|---|
| | After printing on 10000 sheets at high temperature and high humidity | | | | After standing one day at high temperature and high humidity | | | |
| | Ghost | Fogging | Streak | Image degradation | Ghost | Fogging | Streak | Image degradation |
| Example 1 | A | A | B | A | A | A | B | A |
| Example 2 | A | A | B | A | A | A | B | A |
| Example 3 | A | A | B | A | A | B | B | A |
| Example 4 | A | A | B | B | A | A | B | A |
| Example 5 | A | A | A | B | A | A | A | A |
| Example 6 | A | A | A | A | A | A | A | A |
| Example 7 | A | A | A | B | A | A | A | A |
| Example 8 | A | A | A | B | A | A | A | A |
| Example 9 | A | A | A | B | A | A | A | A |
| Example 10 | A | A | B | A | A | B | B | A |
| Example 11 | A | A | A | A | A | A | A | B |
| Example 12 | A | A | A | B | A | A | A | A |
| Example 13 | A | B | A | B | A | B | A | A |
| Example 14 | A | A | A | B | A | A | A | B |
| Example 15 | A | A | A | A | A | A | A | A |
| Example 16 | A | A | A | A | A | A | A | A |
| Example 17 | A | A | A | B | A | A | A | A |
| Example 18 | A | A | A | A | A | A | B | A |
| Example 19 | A | A | A | B | A | A | B | A |
| Example 20 | A | A | A | A | A | A | B | A |
| Example 21 | A | A | A | A | A | A | B | A |
| Example 22 | A | A | A | A | A | A | B | A |
| Example 23 | A | A | A | B | A | A | A | A |
| Example 24 | A | A | A | A | A | A | B | A |
| Example 25 | A | A | A | A | A | A | A | A |
| Example 26 | A | A | A | A | A | A | A | A |
| Example 27 | A | A | A | A | A | A | A | A |
| Comparative example 1 | A | B | C | A | A | B | C | A |
| Comparative example 2 | A | B | C | A | A | B | C | A |
| Comparative example 3 | A | B | C | A | A | B | C | A |
| Comparative example 4 | A | B | C | A | A | B | C | A |
| Comparative example 5 | A | B | B | C | A | B | B | C |
| Comparative example 6 | A | B | B | C | A | B | B | C |
| Comparative example 7 | A | B | B | C | A | B | B | C |
| Comparative example 8 | A | A | C | A | A | A | C | A |

What is claimed is:

1. An electrophotographic photoreceptor, comprising:

a conductive substrate; and a photosensitive layer provided on a surface of the conductive substrate, an outermost layer of the photosensitive layer containing a colloidal silica, a binding resin, and a crosslinked product composed of a guanamine compound and at least one charge transporting material comprising a compound represented by Formula (II):

(II)

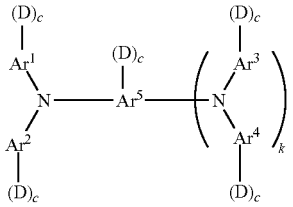

where $Ar^1$ through $Ar^4$ may be the same or different from each other and each independently represent a substituted or unsubstituted aryl group;

$Ar^5$ represents a substituted or unsubstituted aryl group or a substituted or unsubstituted arylene group;

D represents $—(—R_7—X)_{n1}R_8—Y$;

$R_7$ and $R_8$ each independently represent a linear or branched alkylene group having 1 to 5 carbon atoms;

n1 represents 0 or 1; X represents oxygen, NH, or sulfur atom;

Y represents —OH, $—OCH_3$, $—NH_2$, —SH, or —COOH;

each c independently represents 0 or 1;

k represents 0 or 1; and a total number of D is 3 or 4, wherein the guanamine compound is at least one selected from the group consisting of a compound represented by the following formula (A) and multimers thereof:

(A)

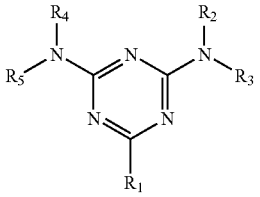

where in the formula (A), $R_1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms;

$R_2$ through $R_5$ each independently represent a hydrogen atom, —$CH_2$—OH, or —$CH_2$—O—$R_6$; and $R_6$ represents a hydrogen atom or a linear or branched alkyl group having 1 to 10 carbon atoms;

a ratio by weight of the charge transporting material to the guanamine compound in the outermost layer is from 0.2:1 to 4:1;

an amount of the guanamine compound in the outermost layer with respect to the entire outermost layer is from 10% by weight to 80% by weight; and the binding resin of the outermost layer consists of the guanamine compound or consists of the guanamine compound and at least one of a polyvinyl acetal resin or a polyvinyl phenolic resin.

2. The electrophotographic photoreceptor of claim 1, wherein in the formula (A), $R_1$ represents a substituted or unsubstituted phenyl group having 6 to 10 carbon atoms, and $R_2$ through $R_5$ represent —$CH_2$—O—$R_6$.

3. The electrophotographic photoreceptor of claim 1, wherein in the formula (A), $R_6$ is selected from a methyl group or a n-butyl group.

4. A process cartridge, comprising:

the electrophotographic photoreceptor of claim 1; and at least one member selected from the group consisting of a charging unit for charging the electrophotographic photoreceptor, a development unit for developing an electrostatic latent image formed on the electrophotographic photoreceptor with a toner, and a toner removal unit for removing residual toner from the surface of the electrophotographic photoreceptor.

5. The process cartridge of claim 4, wherein the development unit comprises a developer retainer that moves in a direction opposite to a traveling direction of the electrophotographic photoreceptor.

6. The process cartridge of claim 4, wherein the compound represented by Formula (II) is a member selected from the group consisting of:

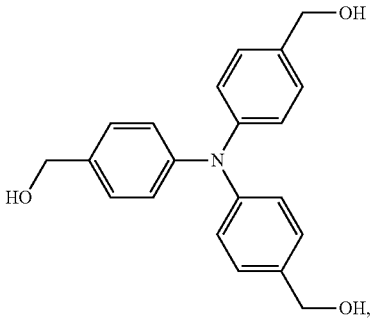

-continued

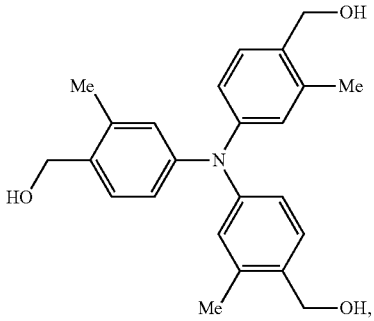

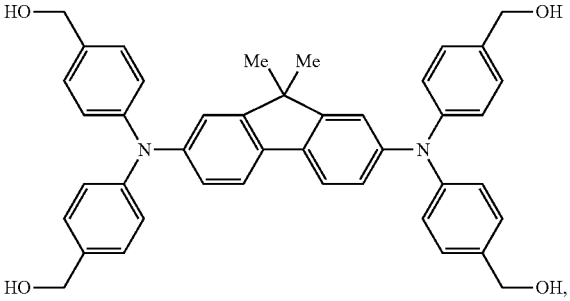

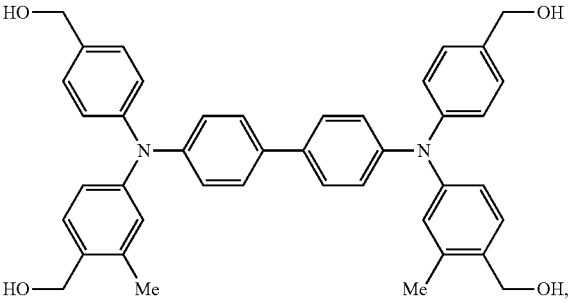

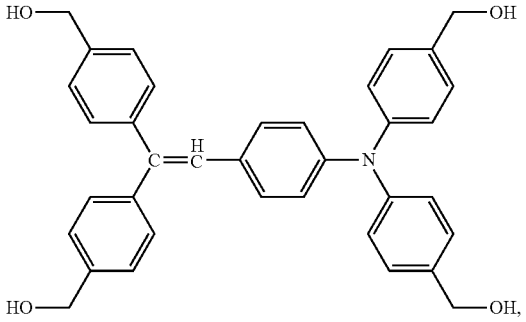

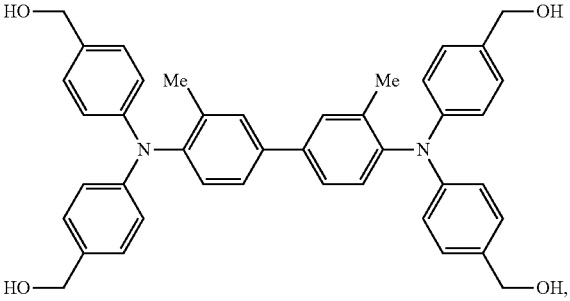

-continued

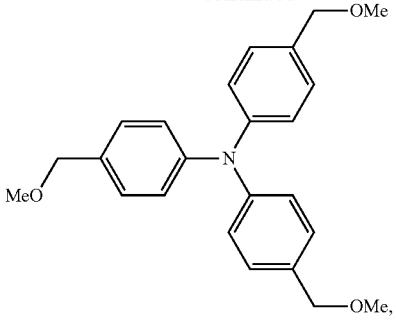

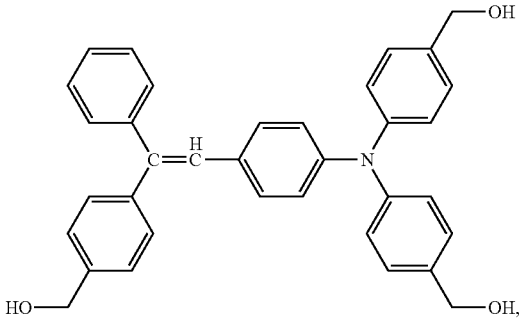

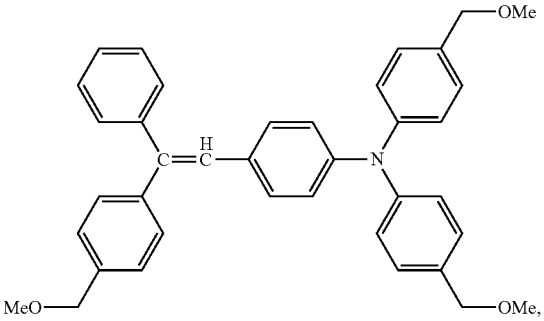

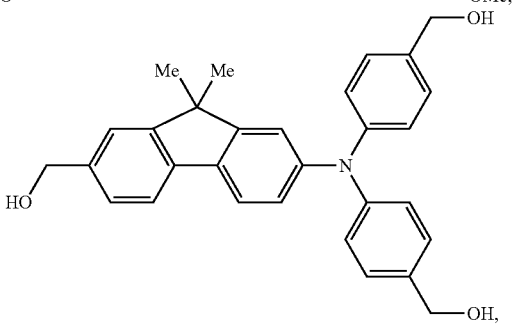

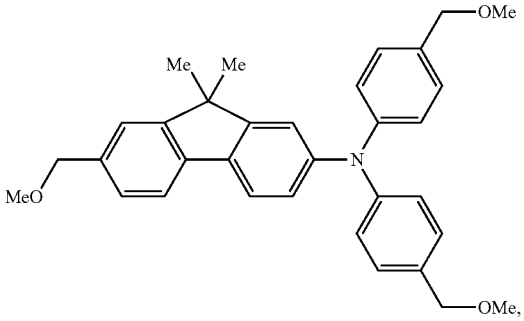

-continued

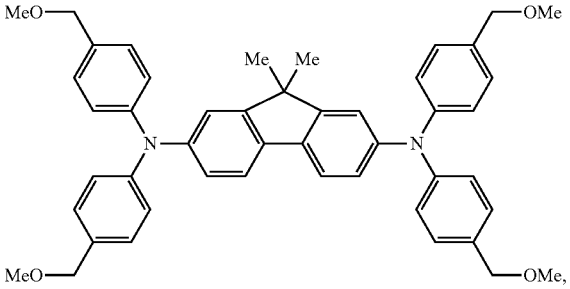

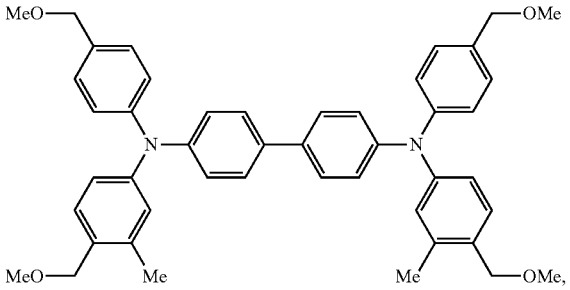

and

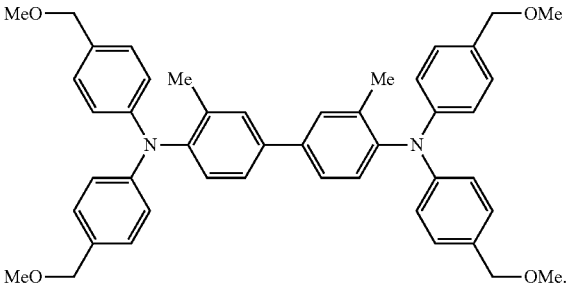

7. An image forming apparatus, comprising:

the electrophotographic photoreceptor of claim 1;

a charging unit for charging the electrophotographic photoreceptor;

an electrostatic latent image unit for forming an electrostatic latent image on the charged electrophotographic photoreceptor;

a development unit for developing an electrostatic latent image formed on the electrophotographic photoreceptor with a toner; and a transfer unit for transferring a toner image to an image receiving medium.

8. The image forming apparatus of claim 7, wherein the development unit comprises a developer retainer that moves in a direction opposite to a traveling direction of the electrophotographic photoreceptor.

9. The image forming apparatus of claim 7, wherein the compound represented by Formula (II) is a member selected from the group consisting of:

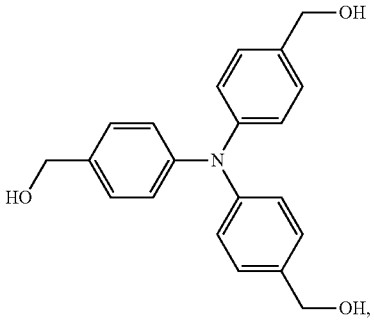
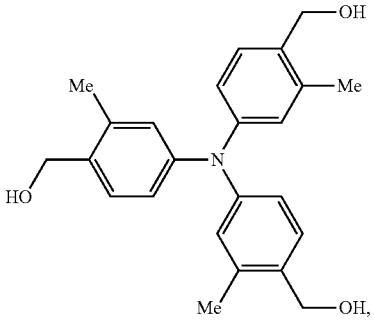
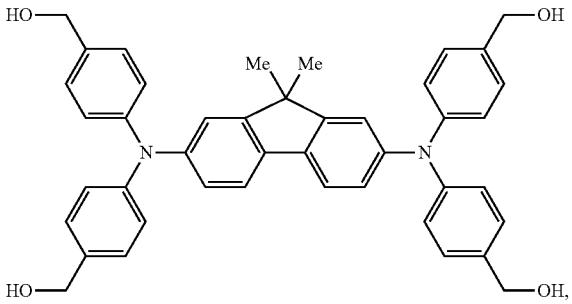
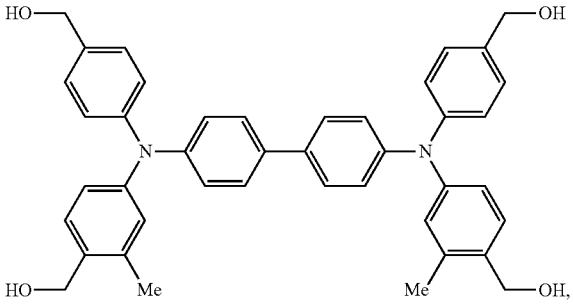
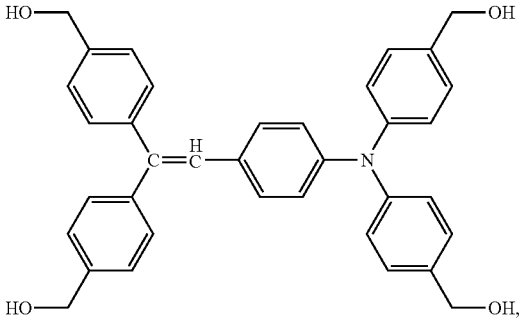
-continued
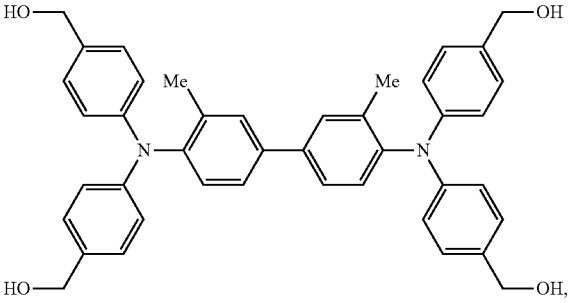
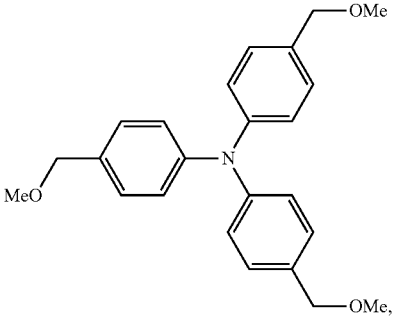
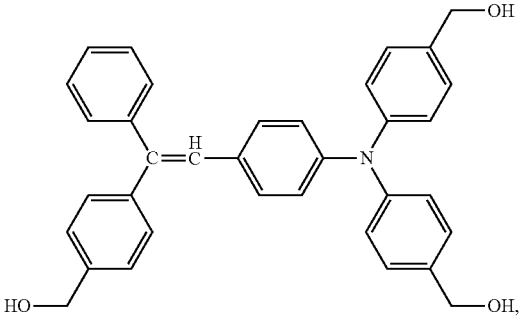
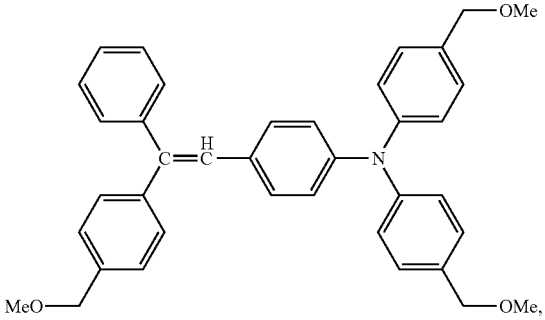
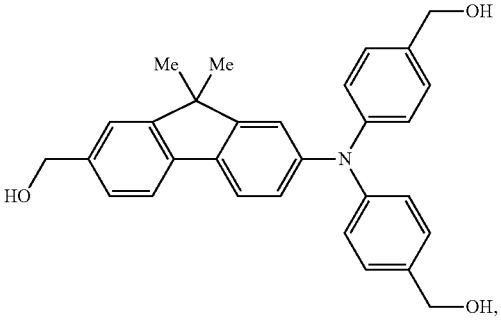

-continued

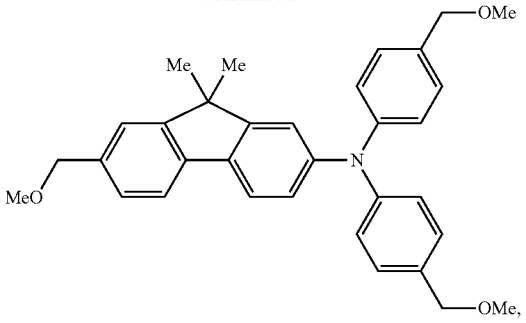

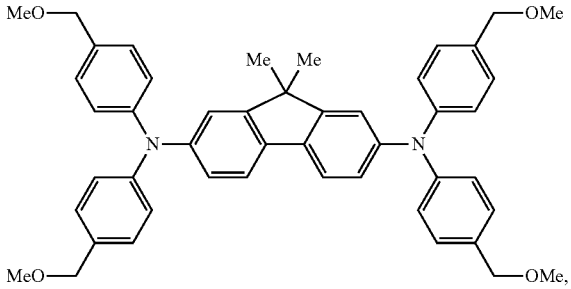

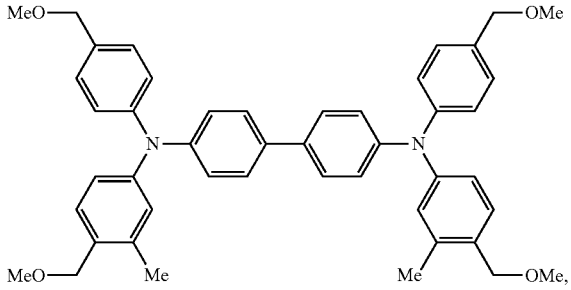

and

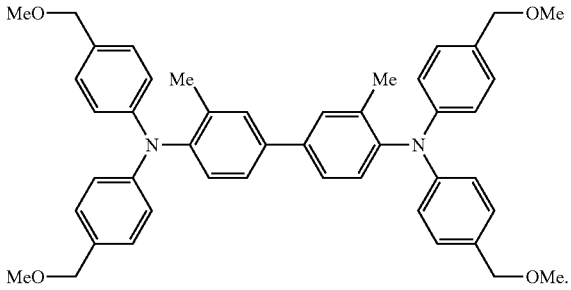

10. The electrophotographic photoreceptor of claim 1, wherein the outermost layer further comprises at least one member selected from the group consisting of a melamine resin, a urea resin, an alkyd resin, a polyamide resin, a cellulose resin, and a polyvinylphenolic resin.

11. The electrophotographic photoreceptor of claim 1, wherein the outermost layer further comprises an antioxidant at a content of 20% by weight or less.

12. The electrophotographic photoreceptor of claim 1, wherein the outermost layer further comprises at least one member selected from the group consisting of a silicon-containing particle, a fluorine particle, and a metal oxide particle.

13. The electrophotographic photoreceptor of claim 1, wherein $R_1$ represents a linear or branched alkyl group having 1 to 10 carbon atoms, or a substituted or unsubstituted alicyclic hydrocarbon group having 4 to 10 carbon atoms.

14. The electrophotographic photoreceptor of claim 1, wherein at least one Y comprises —$OCH_3$.

15. The electrophotographic photoreceptor of claim 1, wherein the compound represented by Formula (II) is a member selected from the group consisting of:

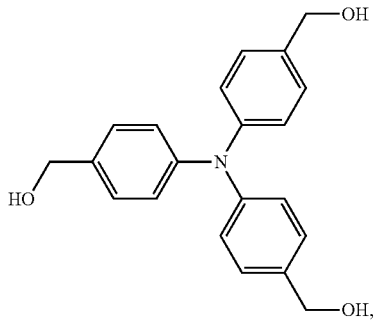

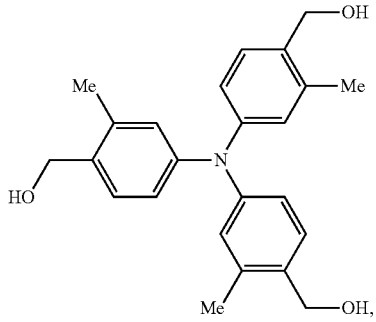

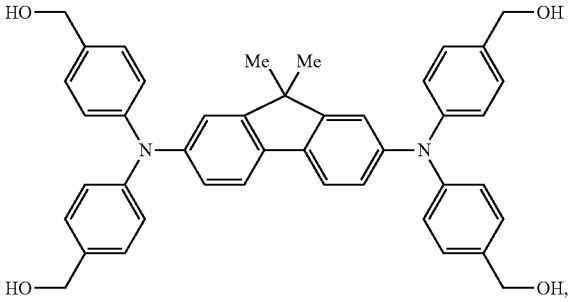

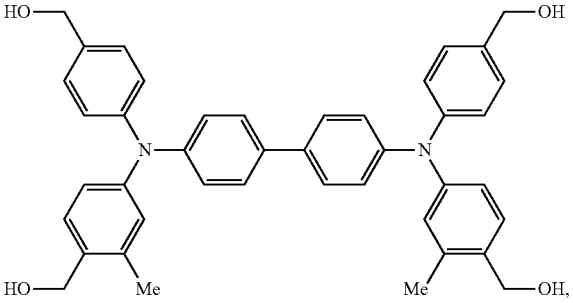

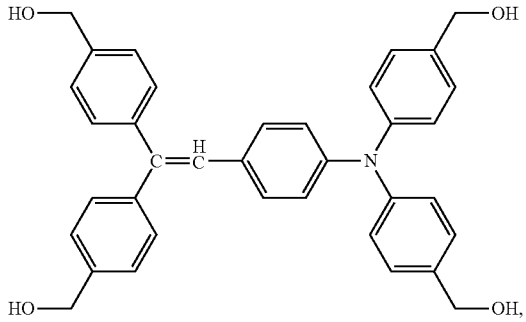

-continued

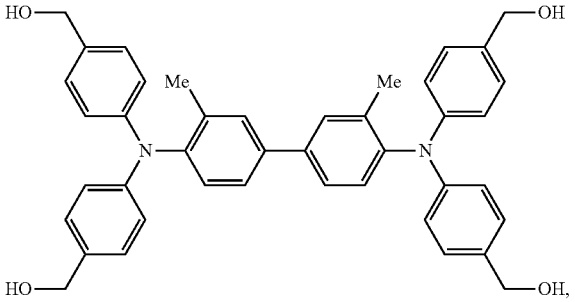

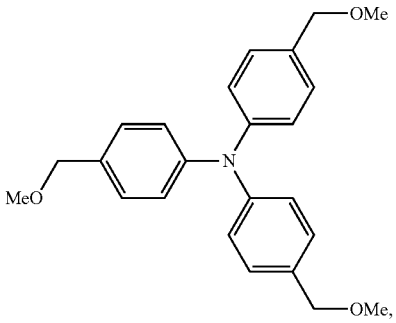

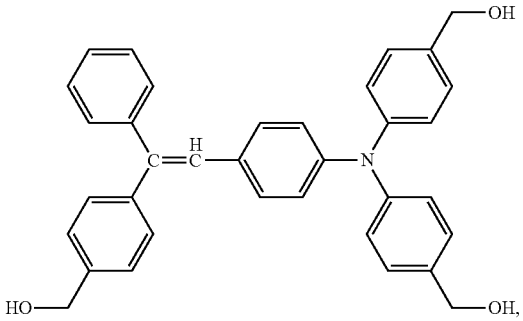

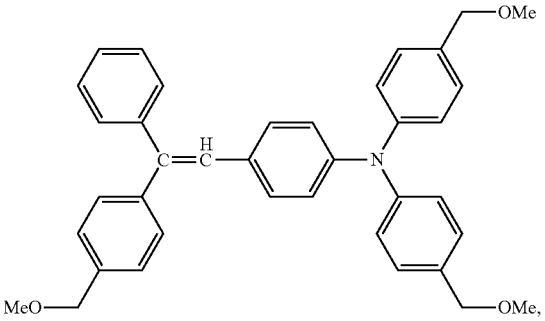

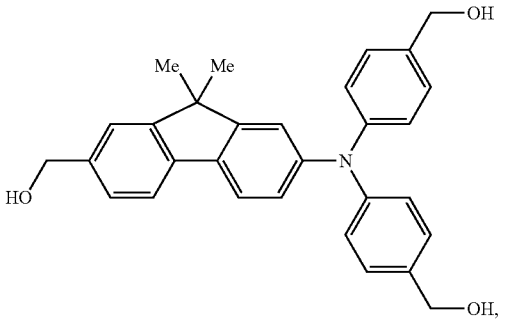

-continued

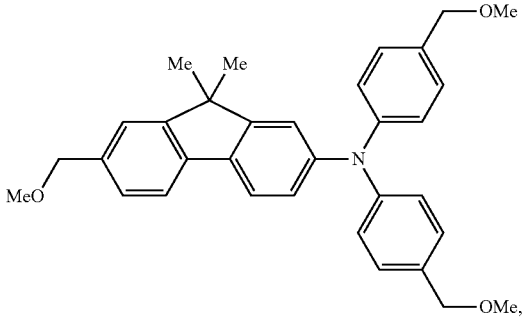

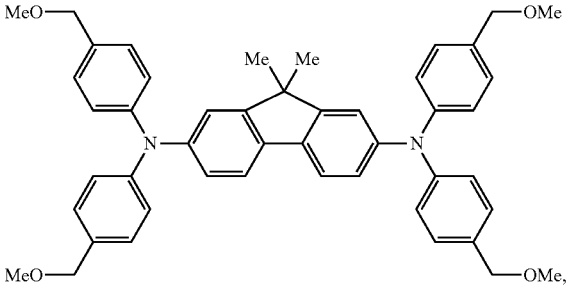

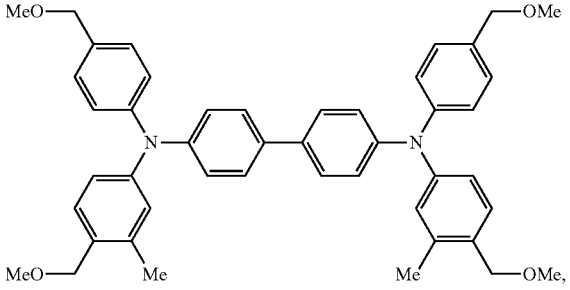

and

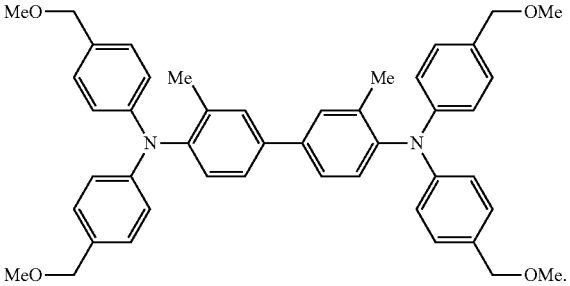

16. The electrophotographic photoreceptor of claim 1, wherein the outermost layer further comprises a curing catalyst.

17. The electrophotographic photoreceptor of claim 16, wherein the curing catalyst comprises a heat latent catalyst.

18. The electrophotographic photoreceptor of claim 16, wherein the curing catalyst comprises at least one of an organic sulfonic acid or a derivative thereof.

19. An electrophotographic photoreceptor, comprising:

a conductive substrate; and a photosensitive layer provided on a surface of the conductive substrate, an outermost layer of the photosensitive layer containing a binding resin and a crosslinked product composed of a guanamine compound and at least one charge transporting material comprising a compound represented by Formula (II):

(II)

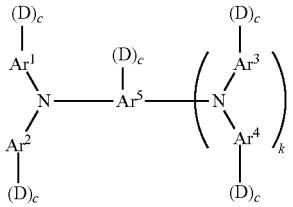

where $Ar^1$ through $Ar^4$ may be the same or different from each other and each independently represent a substituted or unsubstituted aryl group;

$Ar^5$ represents a substituted or unsubstituted aryl group or a substituted or unsubstituted arylene group;

D represents —(—$R_7$—X)$_{n1}$$R_8$—Y;

$R_7$ and $R_8$ each independently represent a linear or branched alkylene group having 1 to 5 carbon atoms;

n1 represents 0 or 1;

X represents oxygen, NH, or sulfur atom;

Y represents —OH, —$OCH_3$, —$NH_2$, —SH, or —COOH;

each c independently represents 0 or 1;

k represents 0 or 1; and a total number of D is 3 or 4, wherein the guanamine compound is at least one selected from the group consisting of a compound represented by the following formula (A) and multimers thereof:

(A)

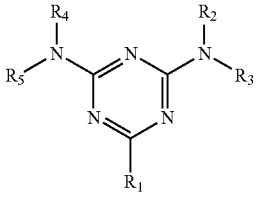

where in the formula (A), $R_1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms;

$R_2$ through $R_5$ each independently represent a hydrogen atom, —$CH_2$—OH, or —$CH_2$—O—$R_6$; and $R_6$ represents a hydrogen atom or a linear or branched alkyl group having 1 to 10 carbon atoms;

a ratio by weight of the charge transporting material to the guanamine compound in the outermost layer is from 0.2:1 to 4:1;

an amount of the guanamine compound in the outermost layer with respect to the entire outermost layer is from 10% by weight to 80% by weight; and the binding resin of the outermost layer consists of the guanamine compound or consists of the guanamine compound and at least one of a polyvinyl acetal resin or a polyvinyl phenolic resin.

20. The electrophotographic photoreceptor of claim 19, wherein the compound represented by Formula (II) is a member selected from the group consisting of:

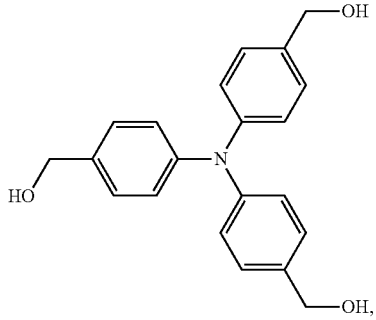

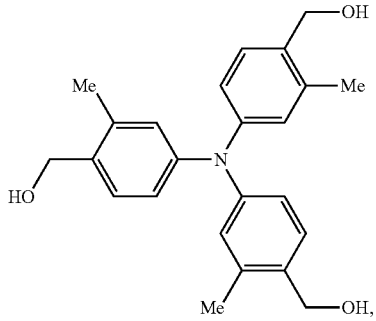

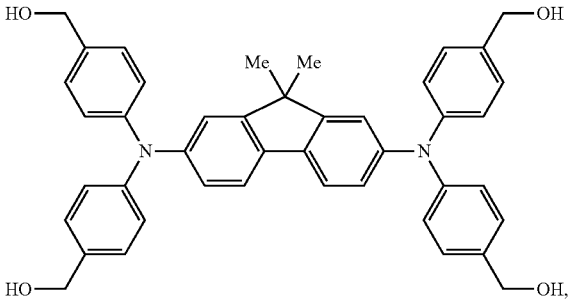

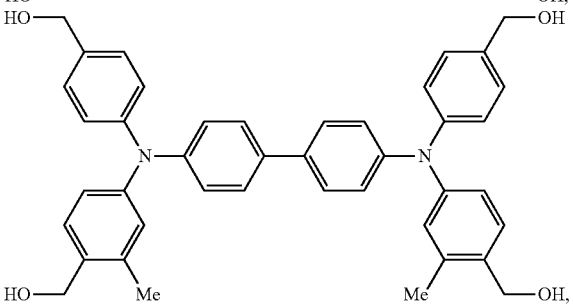

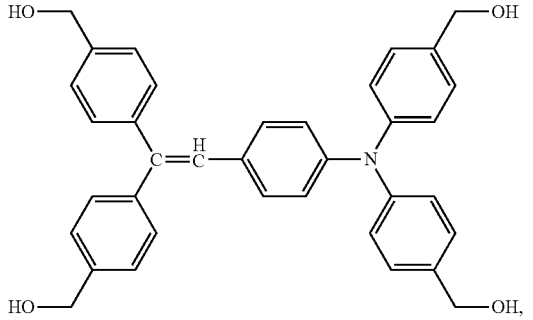

-continued
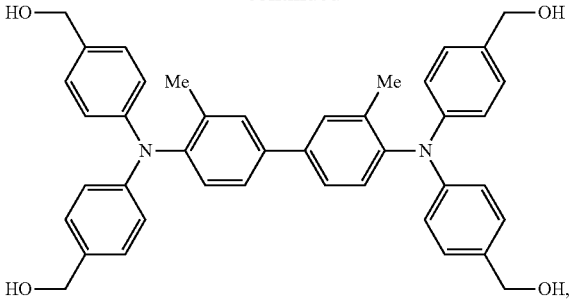
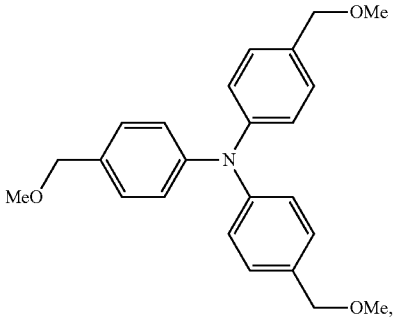
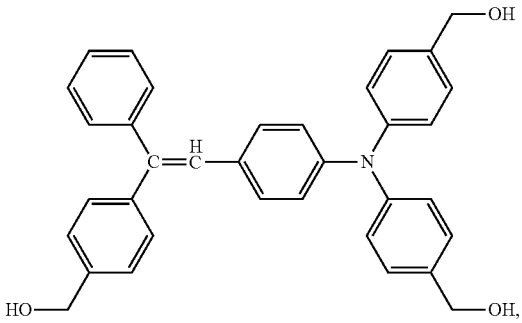
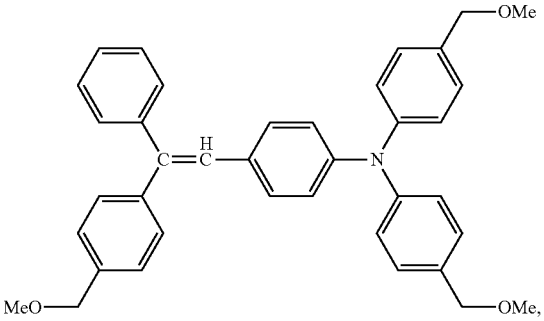
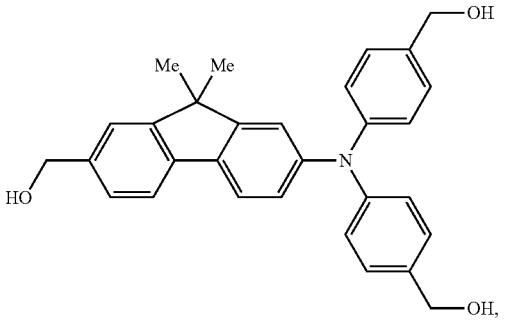
-continued
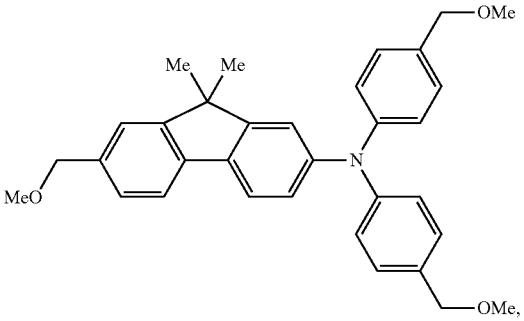
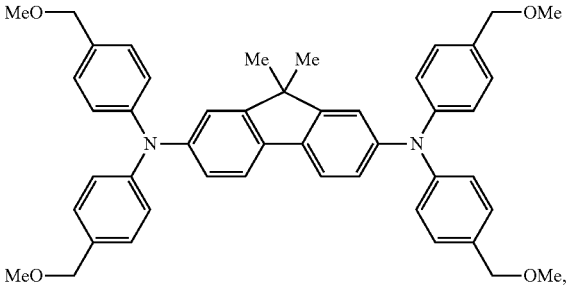
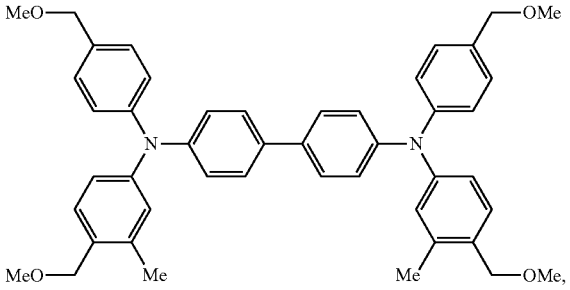
and
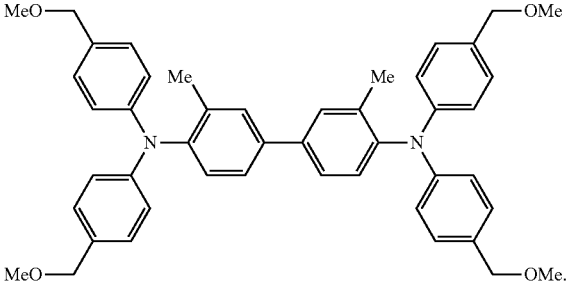
* * * * *